US008541721B2

(12) United States Patent
Moskal et al.

(10) Patent No.: US 8,541,721 B2
(45) Date of Patent: Sep. 24, 2013

(54) WAKE GENERATING SOLID ELEMENTS FOR JOULE HEATING OR INFRARED HEATING

(75) Inventors: Daniel Moskal, Chicago, IL (US); Maurice J. Marongiu, Plainfield, IL (US)

(73) Assignee: Daniel Moskal, Chicago, IL (US)

( * ) Notice: Subject to any disclaimer, the term of this patent is extended or adjusted under 35 U.S.C. 154(b) by 1331 days.

(21) Appl. No.: 12/315,206

(22) Filed: Dec. 1, 2008

(65) Prior Publication Data

US 2010/0132921 A1 Jun. 3, 2010

(51) Int. Cl.
*H05B 3/06* (2006.01)
*F28D 15/00* (2006.01)

(52) U.S. Cl.
USPC ..... 219/520; 219/618; 219/539; 219/550; 219/530; 219/439; 219/540; 392/346; 392/453; 392/447; 392/497; 392/482; 338/235; 338/280; 338/290; 165/181; 126/400; 439/919

(58) Field of Classification Search
USPC ..... 219/520, 618, 539, 550, 530, 439, 219/540; 392/346, 453, 447, 497, 482; 338/235, 280, 290; 165/104.19, 181; 126/400; 439/919
See application file for complete search history.

(56) References Cited

U.S. PATENT DOCUMENTS 1,805,885 A 5/1931 Rinderspacher et al.
3,453,416 A * 7/1969 Mekjean ..... 219/530
3,885,936 A 5/1975 Limebeer
3,952,182 A 4/1976 Flanders
4,079,233 A 3/1978 Meywald
4,350,872 A 9/1982 Meywald et al.
4,459,466 A 7/1984 Nakagawa et al.
4,567,350 A 1/1986 Todd, Jr.
4,638,147 A 1/1987 Dytch et al.
4,690,211 A 9/1987 Kuwahara et al.
4,770,233 A 9/1988 Hansen
5,014,339 A 5/1991 Tattermusch
5,020,127 A 5/1991 Eddas et al.
5,334,818 A 8/1994 Edwards et al.
5,355,946 A 10/1994 Wei et al.
6,205,292 B1 3/2001 Pokorny et al.
6,236,810 B1 5/2001 Kadotani
6,621,984 B2 9/2003 Castaneda et al.
6,721,497 B2 4/2004 Gruzdev et al.
6,808,016 B2 10/2004 Wu et al.
6,817,283 B2 11/2004 Jones et al.
6,820,685 B1 11/2004 Carter et al.
6,909,842 B2 6/2005 Dufour
6,964,296 B2 11/2005 Memory et al.
(Continued)

*Primary Examiner* — Shawntina Fuqua
(74) *Attorney, Agent, or Firm* — Ryndak & Suri LLP

(57) ABSTRACT

An improved solid heat transfer element composed of an elongate member having a generally cylindrical surface with male vortex generating protrusions is provided. The vortex generating protrusions, which may be referred to as "turbulators," provide improved heat transfer by convection to a flow of air transverse to the elongate members without substantially increasing the pressure drop in the flow of air passing over the members. Advantageously, a plurality of the heat transfer elements, or of straight portions of a single serpentine heat transfer element, may be arranged in an aligned or staggered array of elements or straight portions. Many advantageous profile shapes of the element and vortex generators are provided, including aerodynamic profile shapes that are symmetrical with respect to a fluid flow to provide low drag and pressure drop. Heat in the element may be generated by means of electrical resistance or absorption of radiation.

35 Claims, 16 Drawing Sheets

(56) References Cited

U.S. PATENT DOCUMENTS 6,973,260 B2 12/2005 Orr et al.
7,046,918 B1 5/2006 Burkett et al.
7,228,711 B2 6/2007 Taras et al.
2007/0023411 A1 2/2007 Angelis et al.

* cited by examiner

WAKE GENERATING SOLID ELEMENTS FOR JOULE HEATING OR INFRARED HEATING

FIELD OF INVENTION

This invention relates to improved solid heating elements providing good heat transfer and low pressure drop.

BACKGROUND OF THE INVENTION

"Solid heat transfer element" is a term used to describe heat transfer bodies that are in contact with one fluid flow at a time and are solid in the center. For example, one known type of solid heat transfer element is resistance heating wire where the heat is created by electricity passing through electrically resistive material. Another type is a solid element made of material that absorbs infrared heat, the infrared radiation typically being created by infrared lamps.

Resistance heating wire was one of the first applications of electricity, and many designs exist. However, current resistance heating wires are deficient because they cause significant pressure drops and do not transfer heat effectively.

Finned strip heating elements are a well known alternative form of electrical resistance heating element. Typically, they include an inner material which heats up when electricity is applied via induction heating and a thermally conductive outer casing with extended fins for the purpose of increasing the surface area, thus providing some increased heat transfer. However, they are deficient in many ways. For instance, their complex design makes them expensive to produce. Also, heat can travel along the fins instead of into the passing fluid. The fins typically extend well above the normal boundary layer and create significant turbulence, and so they do not control pressure drop well in relation to the benefit of increased heat transfer. In addition, the multiple parts necessitate that finned strip heating elements be significantly larger in profile than heating elements typically are, which may limit the applications for which they can be utilized.

Infrared heat has usually been used to heat a solid or liquid directly, the infrared radiation from the heat lamp being absorbed directly by the relatively dense solid or liquid. This is not effective when heating gas directly. For example, air at 25 degrees Celsius has 1/800th the density of water, so there is less absorption of infrared radiation in a gas because of the lower density. There are some known applications where the infrared radiation is used to heat a solid body which then transfers the heat to air. One known design is a flat plate which transfers the heat via natural convection, providing poor heat transfer. Another design employs round, ceramic heating elements which absorb the infrared heat from an infrared lamp, then transfer the heat via forced convection to a fluid flow passing transversely to the elements. However, round elements are not ideal for heat transfer and cause large pressure drops.

A need therefore exists for a solid heat transfer element with improved heat transfer which does not cause a significant increase in pressure drop relative to known solid heat transfer elements.

BRIEF SUMMARY OF THE INVENTION

According to one aspect of the present invention, a solid heat transfer element is provided for generating heat from an electric current passing through its electrically resistant material and transferring the heat to a fluid flow in communication with the solid heat transfer element. The solid heat transfer element includes an elongate member composed of electrically resistive, heat generating material placed transversely to the fluid flow with an aerodynamic profile, symmetrical in respect to the fluid flow, configured to provide reduced drag and pressure drop when compared to less aerodynamic profile shapes using the same volume of material. For example, a tear drop shaped profile is generally more aerodynamic than a circular profile. The elongate member has a cylindrical surface including a surface area in contact with the fluid flow and male protrusions extending from the cylindrical surface into the fluid flow, the male protrusions configured to provide additional surface area in contact with the fluid flow and to generate vortices to mix heated fluid layers.

In one embodiment, the electrically resistive material is composed of a material selected from the group of alloys, powdered metallurgical dispersions and ceramics consisting of FeCrAl, NiFe, NiCrFe, CuNi, CaCu, MoSi, Silicon Carbide, PTC ceramics and resistance wire encased in ceramics, for instance as commercially available under the mark Cal-Rod®.

In another embodiment, the solid elongate member is oriented transversely at an angle between 45 and 90 degrees with respect to the fluid flow.

In still another embodiment, an array of the solid heat transfer elements composed of the elongate members described above is provided. The array may include a plurality of offset rows of the elongate members, each row comprising a plurality of the elongate members spaced apart in a direction transverse to the fluid flow and parallel to one another. The rows may be aligned so that each elongate member in a row is spaced in the direction of fluid flow from a corresponding elongate member in an adjacent row. Alternatively, the rows may be staggered in relation to one another so that no elongate member in a row is spaced in the direction of fluid flow from a corresponding elongate member in an adjacent row.

In yet another embodiment, the elongate member is formed in a serpentine bent pattern, the bent pattern including an array of straight portions of the elongate member, the array comprising a plurality of rows of the straight portions, each row comprising a plurality of the straight portions spaced apart in a direction transverse to the fluid flow and parallel to one another. The rows of the array thus formed may be aligned or staggered similarly to the array formed of a plurality of heat transfer elements.

In still another embodiment, the elongate member may be helical.

In yet another embodiment, at least a part of the elongate member is spiral shaped.

In still another embodiment, the elongate member has a symmetrical profile shape selected from the group consisting of aerofoils, tear drops, egg shapes, wedges, ellipses, circles, and ovals.

In yet another embodiment, the vortex generating male protrusions are of a shape selected from the group consisting of pyramids, cones, aerofoils, circles, ellipses, egg shapes, hemispheres, wedges, triangles, trapezoids, squares and rectangles.

In still another embodiment, the vortex generating male protrusions are oriented at an angle of attack between about 0 and about 45 degrees with respect to the fluid flow.

In another aspect of the present invention, a solid heat transfer element is provided for absorbing energy from a source of electromagnetic radiation and transferring the energy as heat to a fluid flow in communication with the solid heat transfer element. The solid heat transfer element is an elongate member adapted to absorb electromagnetic radiation, the elongate member oriented transversely to the fluid flow and exposed to the source of electromagnetic radiation. The elongate member has an aerodynamic profile that is symmetrical with respect to the fluid flow, to provide relatively low drag and pressure drop, as discussed above. A cylindrical outer surface of the elongate member has a surface area in contact with the fluid flow and male protrusions extending from the cylindrical surface into the fluid flow, the male protrusions configured to provide additional surface area in contact with the fluid flow and to generate vortices to mix heated fluid layers.

In one embodiment, the elongate member is adapted to absorb infrared radiation. Optionally but advantageously, the elongate member may include a coating composed of a material adapted to absorb infrared radiation and a core composed of a material adapted to absorb heat energy conductively from the coating.

In another embodiment, the elongate member is adapted to absorb radio waves, including microwaves. The elongate member may comprise a material from a radio wave absorbing class of materials commonly referred to as "susceptors." The material may be selected from the group of susceptors consisting of carbide, molybdenum, tungsten, silicon carbide, stainless steel and aluminum.

In still another embodiment, the elongate member is placed transversely at an angle between about 45 and about 90 degrees with respect to the fluid flow.

In yet another embodiment, an array of radiation-absorbing solid heat transfer elements is provided composed of an array of the solid elongate members. The array may comprise a plurality of offset rows of the elongate members, each row comprising a plurality of the elongate members spaced apart in a direction transverse to the fluid flow and parallel to one another. The rows of the array may be aligned, such that each elongate member in a row is spaced in the direction of fluid flow from a corresponding elongate member in an adjacent row, or staggered in relation to one another, such that no elongate member in a row is spaced in the direction of fluid flow from a corresponding elongate member in an adjacent row.

In still another embodiment, the elongate member is formed in a serpentine bent pattern, the bent pattern including an array of straight portions of the elongate member, the array comprising a plurality of rows of the straight portions, each row comprising a plurality of the straight portions spaced apart in a direction transverse to the fluid flow and parallel to one another. The rows of the array may be aligned or staggered as described for an array composed of a plurality of elongate members.

In yet another embodiment, the elongate member may be helical.

In still another embodiment, at least a part of the elongate member is spiral shaped.

In yet another embodiment, the elongate member has a symmetrical profile shape selected from the group consisting of aerofoils, tear drops, egg shapes, wedges, ellipses, circles, and ovals.

In still another embodiment, the vortex generating male protrusions have a shape selected from the group consisting of pyramids, cones, aerofoils, circles, ellipses, egg shapes, hemispheres, wedges, triangles, trapezoids, squares and rectangles.

In yet another embodiment, the vortex generating male protrusions are oriented at an angle of attack of from about 0 to about 45 degrees with respect to the fluid flow.

In another aspect of the present invention, a method of manufacturing an elongate solid heat transfer element having a defined profile shape and a pattern of raised vortex generators protruding from its periphery is provided, comprising the steps of passing a continuous strip of material between a pair of cooperatively engaged rollers, the rollers having circumferential channels that engage each other to negatively define the profile shape and the pattern of vortex generators; applying force to the strip of material to plastically deform said strip of material to create the defined profile shape and said raised vortex generators; and cutting the continuous strip of material to a desired length to form a solid heat transfer element having the defined profile shape and raised vortex generators.

In one embodiment, the strip of material is selected from the group consisting of prefabricated round wire, wire extruded into a shape similar to the profile shape, and strips of ribbon shaped material.

In another aspect of the present invention, a method of manufacturing a solid heat transfer element having a defined profile shape and raised vortex generators is provided, comprising the steps of enclosing material from which said solid heat transfer element is to be made between two halves of a mold, said mold defining a negative pattern of said profile shape and a negative pattern of said raised vortex generators, to deform the material into a member having the defined profile shape and raised vortex generators; and separating said mold halves to remove the member from the mold.

In one embodiment, the material is liquid metal, and the liquid metal is retained in the mold to cool and solidify the liquid metal before separating said mold halves.

In another embodiment, the material is a molten ceramic material, and the molten ceramic material is retained in the mold to cool and solidify the ceramic material before separating said mold halves.

In still another embodiment, the mold is filled with metallic or ceramic powder and heat fused by a sintering method.

In yet another embodiment, the mold is used to forge the material by stamping.

REFERENCE NUMERALS IN DRAWINGS

Figure 1:
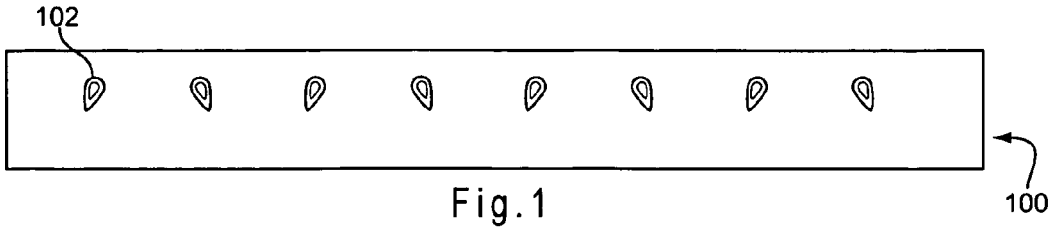
FIG. 1 shows a tear drop profile solid heat transfer element with one row of tear drop shaped vortex generators which taper as they rise from the solid heat transfer element and are placed at a 45 degree angle of attack in respect to the fluid flow, from a top view.

100 Tear drop shaped profile element.

102 Vortex generator, tear drop shaped, which taper as they rise from the solid heat transfer element and placed at a 45 degree angle of attack.

104 Vortex generator, egg shaped, which are rounded at the top and placed at a 45 degree angle of attack.

106 Vortex generator, straight and symmetrical in relation to fluid flow, or at 0 degree angle of attack.

108 Vortex generator, straight and at 0 degree angle of attack.

110 Vortex generator, symmetrical wedge in relation to fluid flow and at 0 degree angle of attack.

112 Vortex generator, straight and at 15 degree angle of attack.

114 Solid heat transfer element, elongated tear drop shape.

116 Vortex generator, tear drop shaped at 0 degree angle of attack.

118 Texturized surface, or micro vortex generators below the boundary layer.

120 Solid heat transfer element with 6 sided polygon profile.

122 Vortex generator, asymmetrical wedge in relation to fluid flow at 0 degree angle of attack.

124 Solid heat transfer element with egg shaped profile.

126 Vortex generator, asymmetrical wedge and at 0 degree angle of attack. Rotated 45 degrees for solid heat transfer heating elements installed at 45 degrees in respect to fluid flow.

128 Solid heat transfer element with 5 sided polygon profile.

130 Vortex generator, elliptical and at 0 degree angle of attack of relatively moderate height.

132 Solid heat transfer element with trapezoidal profile.

134 Vortex generator with round profile, of higher height.

136 Vortex generator with round profile, of higher height and smaller circumference than 134.

140 Vortex generator with round profile and lower height.

142 Vortex generator with round profile and lower height, smaller in circumference than 140.

144 Solid heat transfer element with leaf like profile.

146 Vortex generator, tear drop shaped at 45 degree angle of attack.

148 Solid heat transfer element with tadpole like profile.

150 Vortex generator, tear drop shaped at 30 degree angle of attack.

152 Vortex generator, tear drop shaped at 15 degree angle of attack.

154 Vortex generator, tear drop shaped at 15 degree angle of attack. Rotated 45 degrees for solid heat transfer heating elements installed transversely at a 45 degree angel in respect to fluid flow.

156 Wall of fluid channel.

158 Solid heat transfer element placed transversely to fluid flow at perpendicular angle.

160 Solid heat transfer element placed transversely to fluid flow at 45 degree angle.

162 Vortex generator, tear drop shaped at 30 degree angle of attack. Rotated 45 degrees for solid heat transfer heating elements installed transversely at a 45 degree angel in respect to fluid flow.

164 Vortex generator of indeterminate shape and angle of attack.

166 Serpentine solid heat transfer element formed into Archimedes spiral.

168 Serpentine solid heat transfer element formed into up and down pattern.

170 Serpentine solid heat transfer element formed into coil.

172 Serpentine solid heat transfer element formed into up and down pattern 3 rows deep.

174 Serpentine solid heat transfer element formed into Archimedes spiral 3 rows deep.

176 Solid heat transfer element with thin rectangular profile, or a ribbon element.

178 Vortex generator, triangle shape at 0 degree angle of attack.

180 Hood containing infrared lamp bulbs or magnetron.

181 Ribbon shaped solid heat transfer element which absorbs infrared radiation or radio wave radiation.

182 Extrusion dye profile.

184 Solid heat transfer element, tear drop profile with raised band of material.

186 Gear wheel for deforming solid heat transfer element.

188 Negative tear shaped profile for plastically deforming a tear drop shape profile, or to match a pre-formed profile shape.

190 Female indention in gear wheel for creating raised vortex generator in tear drop shaped.

194 Mold casting, top half.

196 Mold casting, bottom half. A mirror of 194.

198 Negative space for creating the bulk of the solid heat transfer element.

200 Dimple in mold for creating raised vortex generators.

DETAILED DESCRIPTION

This invention is a substantially new way to look at solid heat transfer elements placed in a fluid stream for the purpose of efficient surface heat transfer to the fluid stream via forced or natural convection. The solid heat transfer elements of the present invention are in contact with only one fluid flow. The fluid is moved by means of fans, propellers, gravity, suction or other mechanical means of moving air or gases, or by natural convection. The solid heat transfer element's source of heat comes from electricity, not mechanical energy, the solid element being heated by resistance to electric flow passing through it, by absorbing infrared radiation from a source external to the solid heat transfer element, typically an infrared emitting lamp, or by absorbing radio wave electromagnetic radiation, typically from a magnetron. The present invention utilizes vortex generators to increase heat transfer. Specifically, the use of vortex generators, also known as turbulators, increase micro turbulence and increase solid heat transfer element surface area for more efficient heat transfer. Furthermore, the invention utilizes streamlined profile shapes to control pressure drop created by the solid heat transfer elements.

Skin and profile drag produce a fluid pressure drop that needs to be overcome by the fluid mover. Since surface area of the elements is small only the profile shape is the major cause of pressure drop. Therefore the present invention reduces the profile drag by choosing better solid heat transfer element profiles while utilizing turbulators to increase the heat transfer to the fluid via the generation of vortices that allow for better mixing of the heated fluid layers. The use of vortex generators greatly enhance heat transfer from a solid to a fluid and its slight increase in pressure drop more than compensates for the minor increase in power needed to move the fluid.

Tests were run using Computational Fluid Dynamics software commercially available from Cham Ltd. that utilizes standard flow turbulence modeling. Software programs using other turbulence models could yield different results for the same input data. It would be impractical to run tests for the thousands of possible combinations of solid heat transfer element profile shapes and vortex generator types and placements, and so several representative combinations were chosen for testing. Thermal transfer and pressure drop quantities were calculated for 3 different profile shapes without vortex generators and with vortex generators where air is the chosen fluid and electrical induction heating is the source of heat. The vortex generators 106 chosen were shaped like those in FIG. 30 and placed like those at a zero degree angle of attack. The profile shapes chosen were an oval shape, an asymmetrical wing shape and a symmetrical tear drop wing shape. The test model had 43 solid heat transfer elements made of aluminum, arranged in a staggered array having rows of 9, 8, 9, 8 and 9 elements respectively. Each element was individually powered with 50 watts, for a total of 2150 watts. The profile depth of each element was 8 mm, with a profile height of 5 mm. The distance along the fluid flow path between the leading edges from one row to the next was 20 mm. The choice of fluid was air at an inlet temperature of 20° C., with an inlet velocity of 5 m/s and a freestream turbulence level of ±5%. The efficiency is calculated by E=Q(watts)/2150 watts, where Q=(mass flow rate)×(specific heat)×(temperature after−temperature before). The addition of turbulators resulted in a 19% increase in efficiency for the oval shape, an 11% increase in efficiency for the asymmetrical wing shape, and a 16% increase in efficiency for the symmetrical wing shape. Surprisingly, while the three profile shapes without vortex generators had significantly different efficiencies, specifically, about 66% for the oval shape, about 71% for the asymmetrical wing shape, and 68% for the symmetrical wing shape, the addition of vortex generators resulted in substantially similar efficiencies for all three shapes, specifically, about 78% for the oval shape, about 79% for the asymmetrical wing shape, and about 79% for the symmetrical wing shape.

The asymmetrical wing shape without vortex generators creates relatively large wakes when compared to the oval or symmetrical tear drop wing shape and had better heat transfer results. When vortex generators are added the thermal transfer efficiency goes up significantly for all three profile shapes and the final results for all three profile shapes with vortex generators are similar. This illustrates that the addition of vortex generators significantly adds to heat transfer efficiency. It also illustrates a surprising and significant benefit of the invention, namely, that the choice of solid heat transfer element profile shape does not significantly affect heat transfer performance when vortex generators are present, and so it allows the profile shape which causes the lowest pressure drop to be chosen. Another significant benefit is that symmetrical heating elements according to the invention may achieve similar heat transfer efficiencies to asymmetrical elements while avoiding the undesirable lift forces created by asymmetrical profile shapes, which could potentially damage the elements and/or create undesirable vibration or noise, as discussed in more detail below.

Description of a Preferred Embodiment

Figure 39:
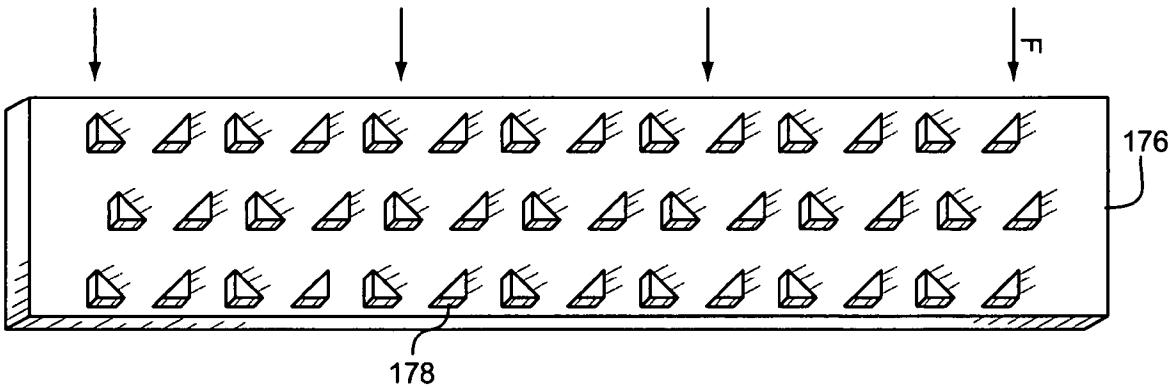
FIG. 39 shows a ribbon solid heat transfer element with three rows of asymmetrical, triangular shaped vortex generators.
Figure 40:
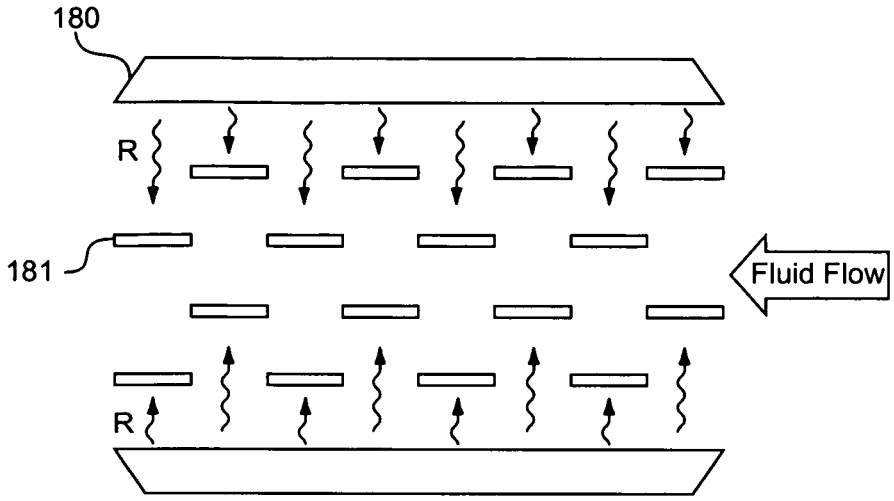
FIG. 40 shows an array of infrared absorbing or radio wave absorbing solid heat transfer elements that absorb radiation from infrared emitting lamps or microwave emitting magnetrons above and below the fluid flow.
Figure 41:
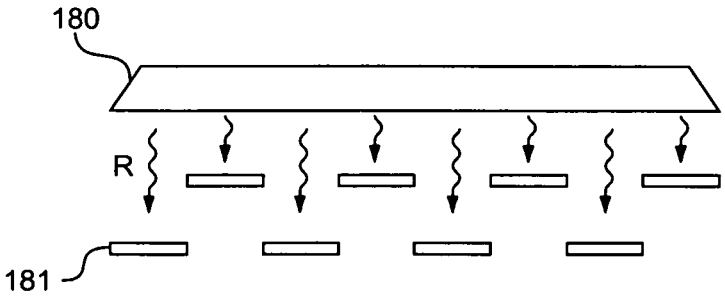
FIG. 41 shows an array of infrared absorbing or radio wave absorbing solid heat transfer elements that absorb radiation from an infrared emitting lamp or microwave emitting magnetron above the fluid flow.

Preferred and alternate embodiments of a heating element according to the present invention are both shown in FIGS. 1-39, while FIGS. 40 and 41 relate only to the alternate embodiments. The drawings in FIGS. 1-39 show the shapes of the solid heat transfer elements, shapes, sizes and placement of the vortex generators and the arrangement of the solid heat transfer elements into an array placed transversely to the fluid flow. The difference is the source of electrically provided heat; the preferred embodiment's source is electric induction heating within the solid heat transfer element, while the alternate embodiment's source is an external heat lamp emitting infrared radiation onto the solid heat transfer elements. In the other alternative embodiment the source of energy for heat is radio waves emitted from a magnetron or other radio wave emitting means. FIGS. 40 and 41 show infrared emitting heat lamps as part of the element array, so they only apply to the alternate embodiment. FIGS. 42-50 show the preferred and alternate embodiments of the manufacturing techniques.

The design choices with solid heat transfer elements and the associated vortex generators are specific to each application. The choice of solid heat transfer element profile shape, spacing between solid heat transfer elements, the angle at which the solid heat transfer elements are transversely placed against the fluid flow, vortex generator shape, spacing between vortex generators, height of vortex generators and the angle of attack of the vortex generators can be combined into thousands of variations. The drawings are provided to illustrate the possible variations and the invention does not limit the invention to the combinations shown in the drawings. The choice of which combination to use for a specific application is driven by heat transfer characteristics and pressure drop control. The choice is also affected by the cost of production and the durability of the chosen design combination.

In the preferred embodiment, the solid heat transfer elements are electrically resistive induction heating elements. The solid heat transfer elements give up heat to the fluid flow, and generate heat from resistance to electricity flowing through them. The material is chosen from a list of alloys, powdered metallurgical dispersions and ceramics including but not limited to FeCrAl, NiFe, NiCrFe, CuNi, CaCu, MoSi, Silicon Carbide, PTC ceramics and resistance wire encased in ceramics, for instance as commercially available under the mark CalRod®.

FIGS. 1-29 and FIGS. 38-39 show a wide variety of solid heat transfer element profiles and vortex generator shapes, orientations and angles of attack. They may be viewed as complete solid heat transfer elements or as a segment of a longer serpentine solid heat transfer element. This list does not limit the invention to these shapes and vortex generators, nor does it limit it to the combinations shown. The drawings illustrate the many possible profile shapes, or planes, of solid heat transfer elements and multiple vortex generator shapes, sizes and orientations. The choice of which profile shape and vortex generator type are used in combination is defined by several key parameters. The profile shapes of the solid heat transfer elements should be symmetrical in relation to the fluid flow and not installed at an angle of attack. While asymmetrical profile shapes, or orientating the solid heat transfer elements at an angle of attack, would create fluid wakes that are effective at transferring heat, they also would create undesirable aerodynamic effects, namely an upward or downward lift. This would create a continuous stress on the solid heat transfer elements, causing durability problems as well as shaking and undesirable noise. Many electrically resistive heating element materials are brittle at high temperatures, exacerbating the problem. The current designs of heating elements that are round or elliptical in shape, and their performance is significantly improved by the addition of vortex generators. They are not shown because of the turbulent wakes their profile shapes create, but are included as a type of symmetrical profile solid heat transfer element. The diameters of the solid heat transfer elements, or in the case of noncircular elements, the widths of their profiles in a direction perpendicular to fluid flow, can vary widely, depending on the application, but are likely to range from a fraction of a millimeter to 10 millimeters. If larger than 10 millimeters the heat in the center of the solid heat transfer element may be too far from the surface to interact with the fluid flow effectively.

The vortex generators serve several purposes. They increase the surface area available for heat transfer. Also, when they are high enough to be above the normal boundary layer, they draw in the faster moving fluid that is further from the solid heat transfer element mixing it with the slower moving fluid next to the element. Vortices increase mixing in the flow, enhance bulk fluid motion, therefore allowing for more heat to be transferred from a solid surface. Although vortices increase pressure drop by increasing flow irreversibilities (entropy), their benefit, heat transfer enhancement, outweighs their negative impact on pressure drop. The present inventors have found that, typically, the increase in efficiency due to the addition of vortex generators overcomes the small increase in pumping power expended.

The vortex generators may be asymmetrically shaped in relation to the fluid flow or orientated at an angle of attack to improve wake generation. While the stresses created by the vortex generators are small, they are ideally oriented so that the asymmetrically shaped vortex generators mirror each other or the angles of attack alternate. This will balance the forces created by the vortex generator's wakes on the solid heat transfer element and control vibration. Also, the angles of attack of the vortex generators do not exceed 45 degrees in relation to the fluid flow, because beyond that angle undesirable fluid flow characteristics are created. Alternately, the vortex generators may be symmetrical in relation to the fluid flow and not placed at an angle of attack. Ideally, the vortex generator protrusions should be slightly higher than the normal boundary layer thickness in order for the system to be able to entertain higher velocity fluid above the normal boundary layer. Vortex generators higher than this may be chosen. At some point the benefit of additional heat transfer with higher vortex generators, from the larger surface area and larger wakes, is outweighed by the additional profile drag, or pressure drop, which the larger vortex generators create. Depending on flow conditions (Reynolds numbers and Prandtl numbers), boundary layer thicknesses may be from a fraction of a millimeter to 10 millimeters. Since the solid heat transfer elements are generally small, and the fluid flow is in contact for a short time with any individual element, the boundary layer thickness is likely to approach the lower end of that range.

Figure 2:
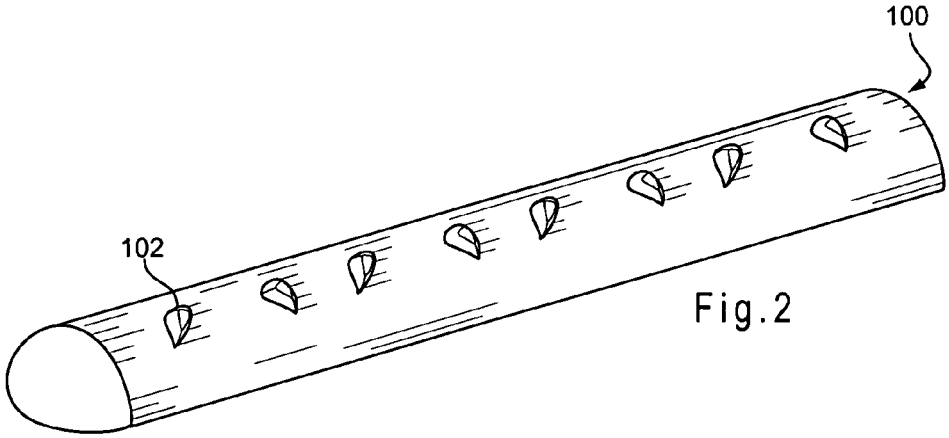
FIG. 2 shows a tear drop profile solid heat transfer element with one row of tear drop shaped vortex generators which taper as they rise from the solid heat transfer element and placed at a 45 degree angle of attack, from a perspective view.
Figure 3:
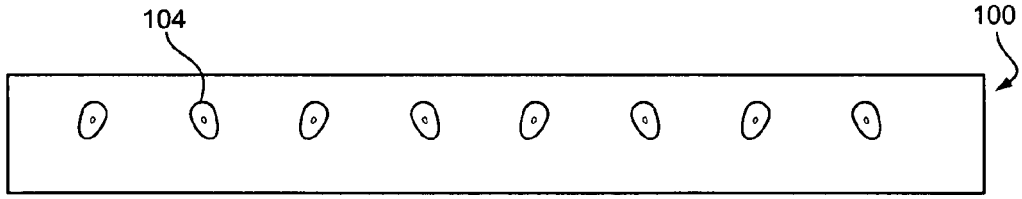
FIG. 3 shows a tear drop profile solid heat transfer element with one row of egg shaped vortex generators with rounded tops placed at a 45 degree angle of attack, from a top view.
Figure 4:
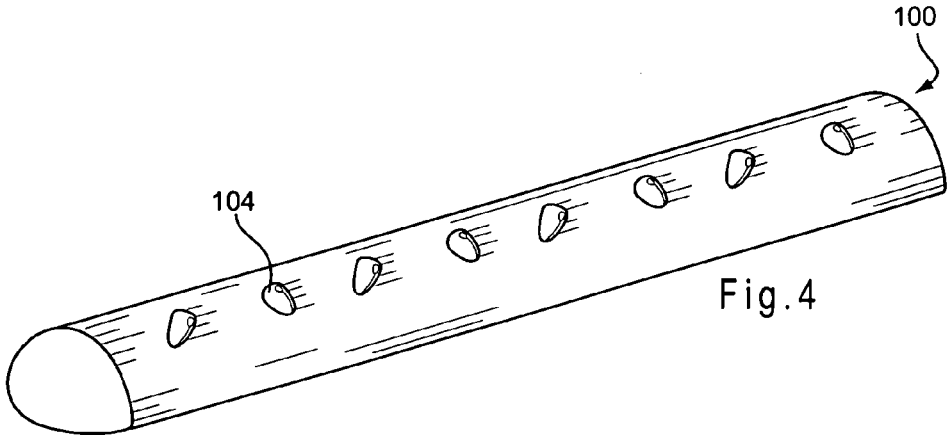
FIG. 4 shows a tear drop profile solid heat transfer element with one row of egg shaped vortex generators with rounded tops placed at a 45 degree angle of attack, from a perspective view.
Figure 5:
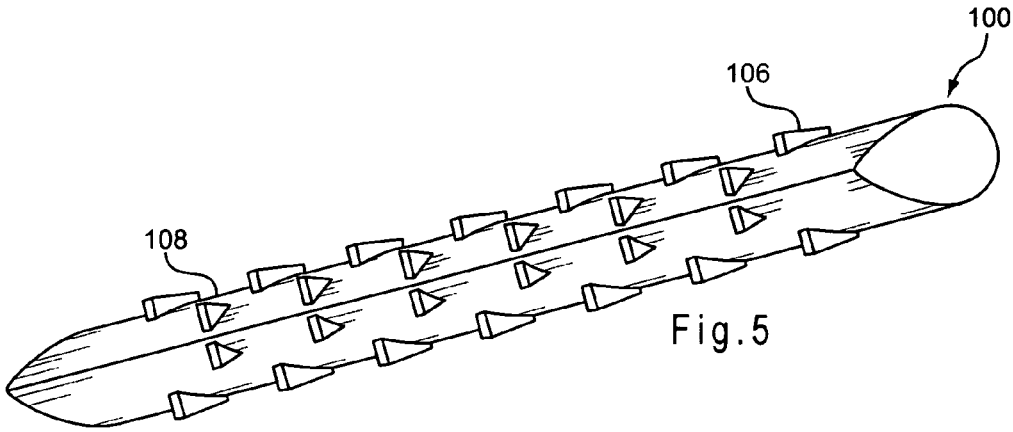
FIG. 5 shows a tear drop profile solid heat transfer element with two rows of vortex generators, symmetrical in respect to the fluid flow, from a perspective view.
Figure 6:
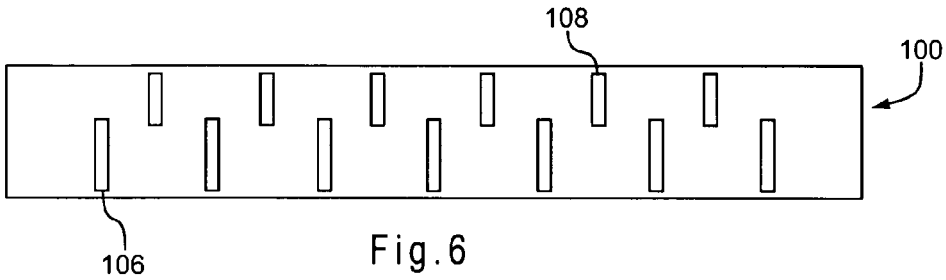
FIG. 6 shows a tear drop profile solid heat transfer element with two rows of symmetrical vortex generators from a top view.
Figure 7:
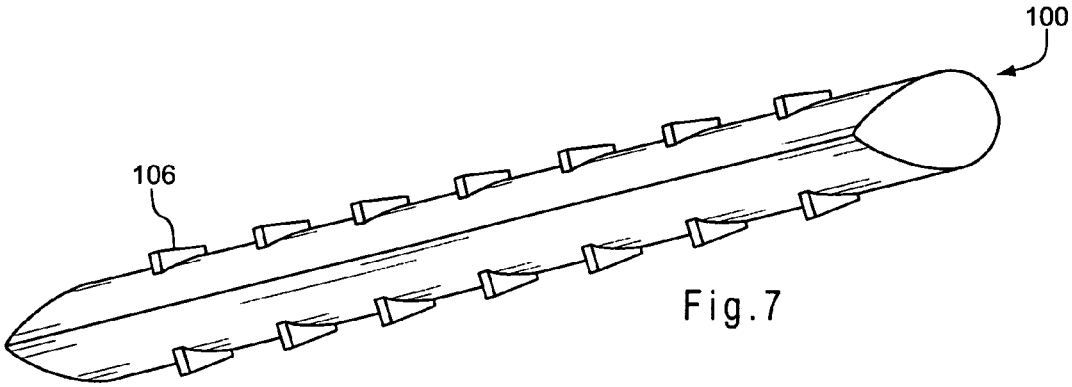
FIG. 7 shows a tear drop profile solid heat transfer element with one row of symmetrical vortex generators from a perspective view.
Figure 8:
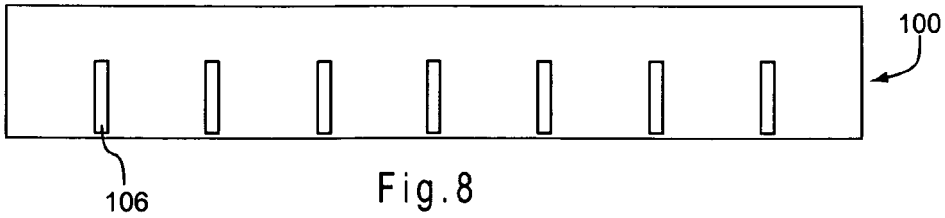
FIG. 8 shows a tear drop profile solid heat transfer element with one row of symmetrical vortex generators from a top view.
Figure 9:
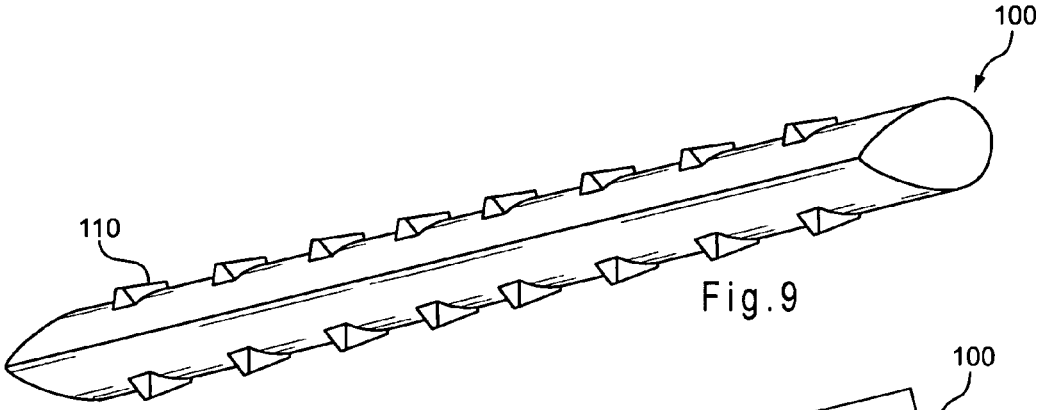
FIG. 9 shows a tear drop profile solid heat transfer element with one row of symmetrical vortex generators that have a wedge shape from a perspective view.
Figure 10:
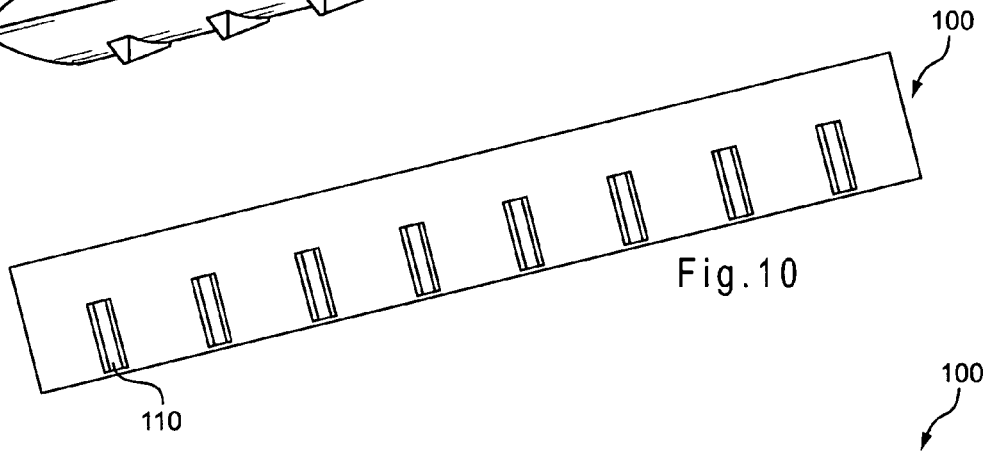
FIG. 10 shows a tear drop profile solid heat transfer element with one row of symmetrical vortex generators that have a wedge shape from a top view.
Figure 11:
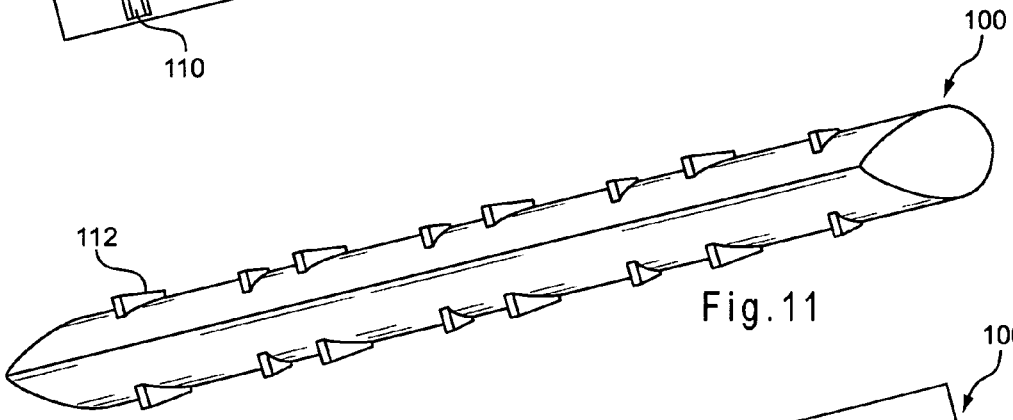
FIG. 11 shows a tear drop profile solid heat transfer element with one row vortex generators at a 15 degree angle of attack from a perspective view.
Figure 12:
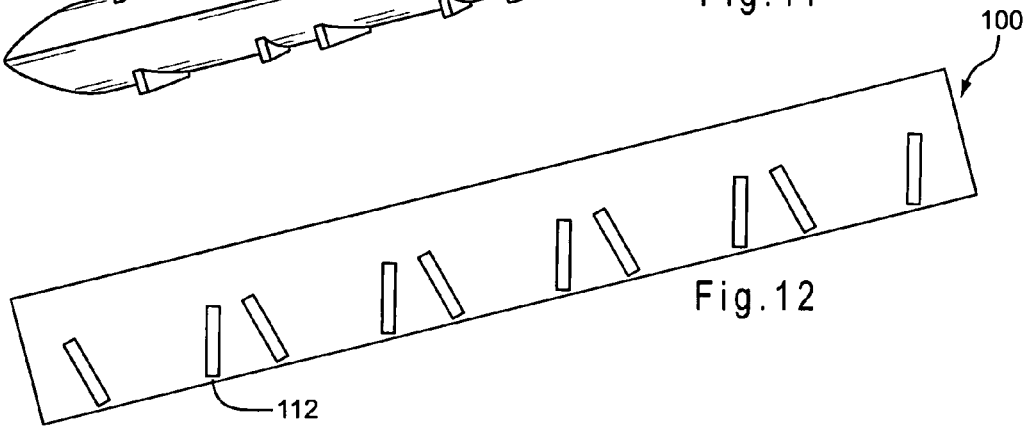
FIG. 12 shows a tear drop profile solid heat transfer element with one row vortex generators at a 15 degree angle of attack from a top view.
Figure 13:
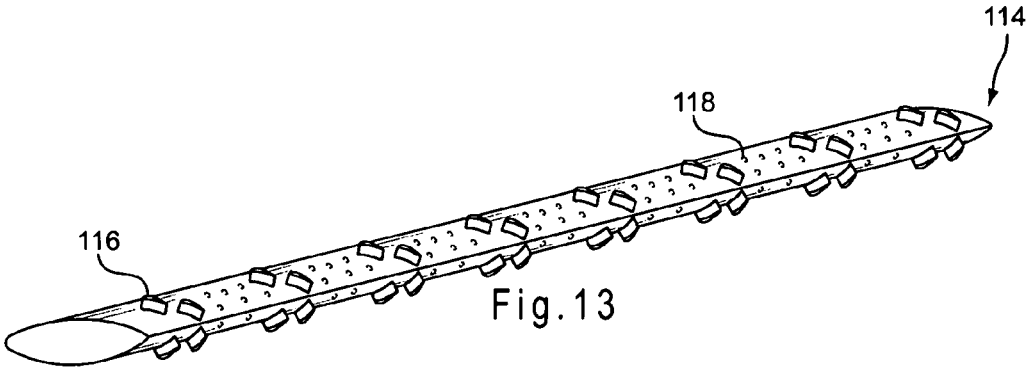
FIG. 13 shows an elongated tear drop profile solid heat transfer element with two rows of symmetrical vortex generators above the boundary layer flow, and a texturized surface below the normal boundary layer from a side perspective view.
Figure 14:
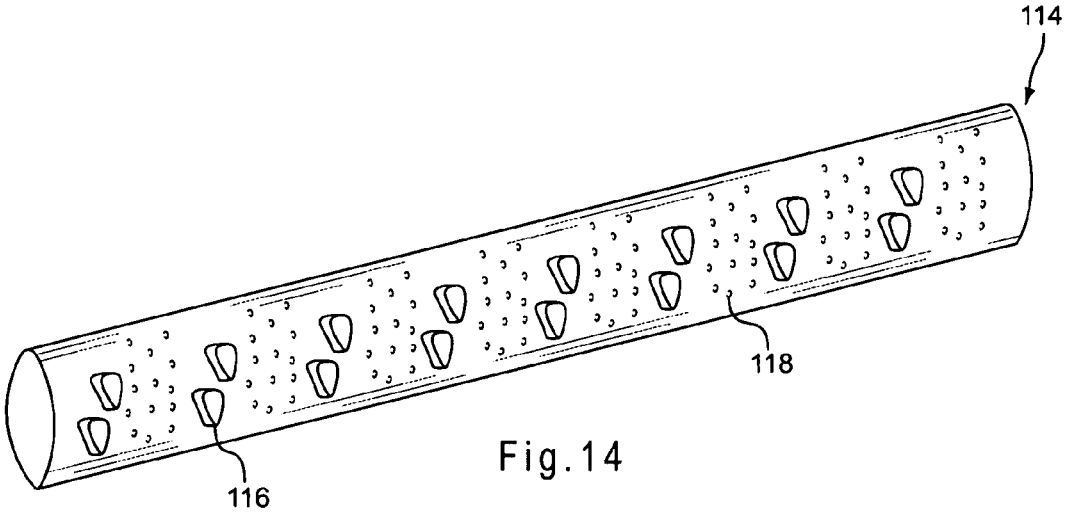
FIG. 14 shows an elongated tear drop profile solid heat transfer element with two rows of symmetrical vortex generators above the boundary layer flow, and a texturized surface below the normal boundary layer from a top perspective view.
Figure 15:
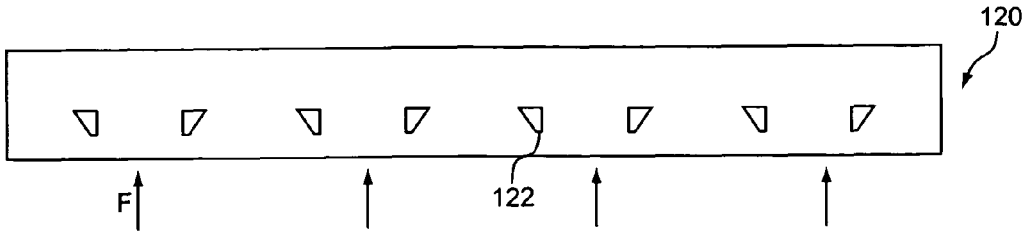
FIG. 15 shows a six sided polygon profile solid heat transfer element with one row of asymmetrical vortex generators from a top view.
Figure 16:
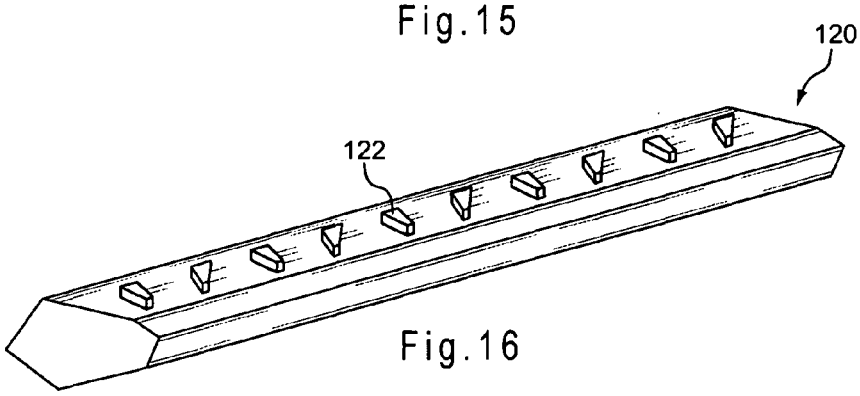
FIG. 16 shows a six sided polygon profile solid heat transfer element with one row of asymmetrical vortex generators from a perspective view.
Figure 17:
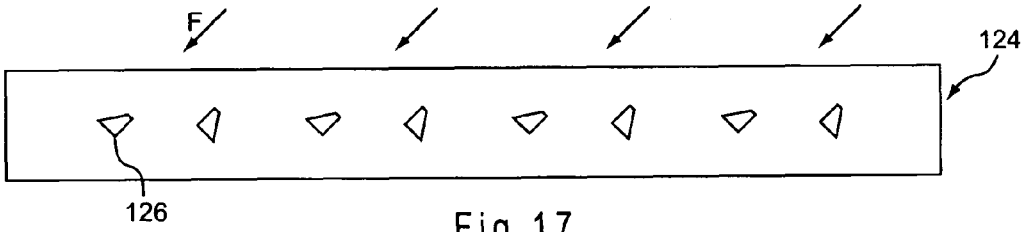
FIG. 17 shows an egg shaped profile solid heat transfer element with one row of asymmetrical vortex generators placed at a 45 degree angle for elements that are installed transversely at a 45 degree angle to the flow from a top view.
Figure 18:
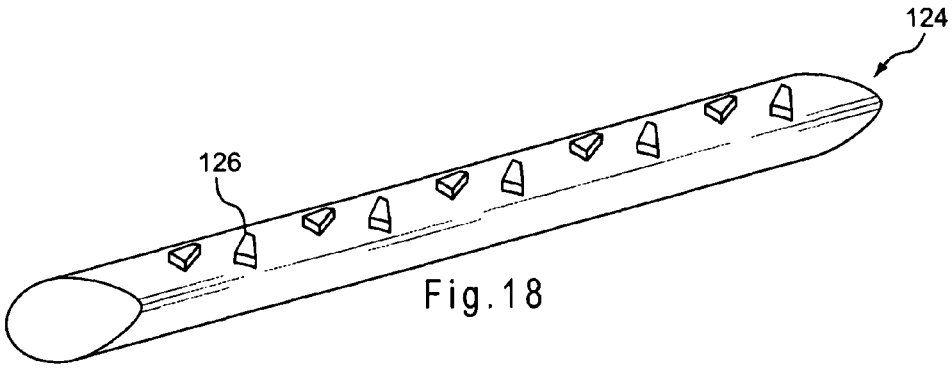
FIG. 18 shows an egg shaped profile solid heat transfer element with one row of asymmetrical vortex generators placed at a 45 degree angle for elements that are installed transversely at a 45 degree angle to the flow from a perspective view.

FIG. 1 shows a perspective view of solid heat transfer element 100 with a tear drop shaped profile; FIG. 2 is the top view. It has one row of vortex generators 102 at a 45 degree angle of attack which are flat topped cones, the base and top of the cone are tear drop shaped. FIG. 3 shows a perspective view of solid heat transfer element 100 with a tear drop shaped profile, FIG. 4 is the top view. It has one row of vortex generators 104 at a 30 degree angle of attack which have an egg shaped profile and a rounded top. They are shaped like an egg that is sliced in half from top to bottom. FIG. 5 shows a perspective view of solid heat transfer element 100 with a tear drop shaped profile, FIG. 6 is the top view. It has two rows of vortex generators 106 and 108 symmetrical to the fluid flow, or at a 0 degree angle of attack. The rows of vortex generators are staggered in relation to each other. FIG. 7 shows a perspective view of solid heat transfer element 100 with a tear drop shaped profile. FIG. 8 is the top view. It has one row of vortex generators 106 at a 0 degree angle of attack. FIG. 9 shows a perspective view of solid heat transfer element 100 with a tear drop shaped profile and FIG. 10 is the top view. Here the vortex generators 110 are symmetrical to the fluid flow, but widen to create a symmetrical wedge shape which increases wake production compared to vortex generator 106. FIG. 11 shows a perspective view of solid heat transfer element 100 with a tear drop shaped profile FIG. 12 is the top view. Here the vortex generators 112 are straight and at a 30 degree angle of attack in respect to the fluid flow. By placing the vortex generators at an angle of attack, the wake production is increased when compared to vortex generator 106. The vortex generators mirror each other; that is, their angles of attack alternate. FIG. 13 shows a side perspective view of solid heat transfer element 114 with an elongated tear drop shaped profile and FIG. 14 is a top perspective top view. It has tear drop shaped vortex generators 116 at a 0 degree angle of attack in respect to the fluid flow which is high enough to be above the boundary layer, as well as a plurality of vortex generators 118 or a texturized surface below the boundary layer. The primary purpose of vortex generators 118 or texturized surface is to increase the heat conductive surface area; they do not create significant wakes. FIG. 15 shows a top view of solid heat transfer element 120 with a six sided polygon profile, with the direction of fluid flow indicated by arrows F. FIG. 16 is the perspective view of element 120. It has a row of vortex generators 122 which are asymmetrical wedges at a zero degree angle of attack in relation to the fluid flow which mirror each other. FIG. 17 shows a top view of solid heat transfer element 124 with an egg shaped profile, with an oblique fluid flow direction indicated by arrows F. FIG. 18 is the perspective view of element 124. It has a row of vortex generators 126 which are asymmetrical wedges at a zero degree angle of attack in relation to the fluid flow. They are angled at 45 degrees so that they are aligned correctly when the solid heat transfer element 124 is installed at a 45 degree angle.

Figure 19:
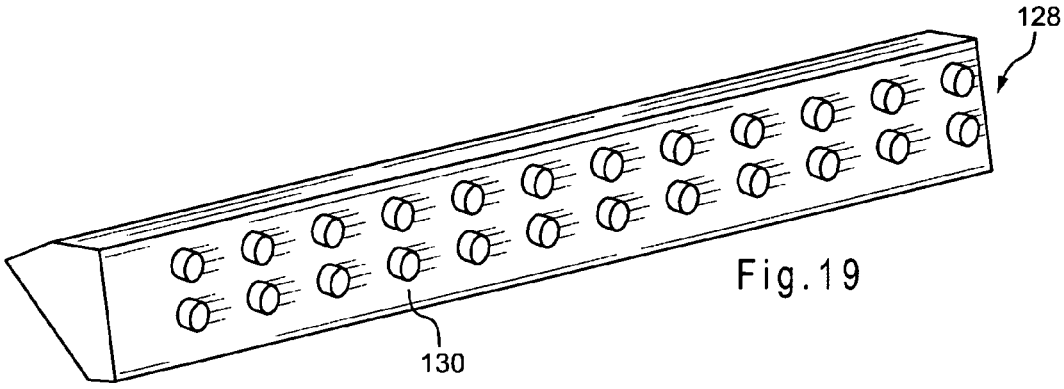
FIG. 19 shows a five sided polygon profile solid heat transfer element with two rows of elliptical vortex generators from a perspective view.
Figure 20:
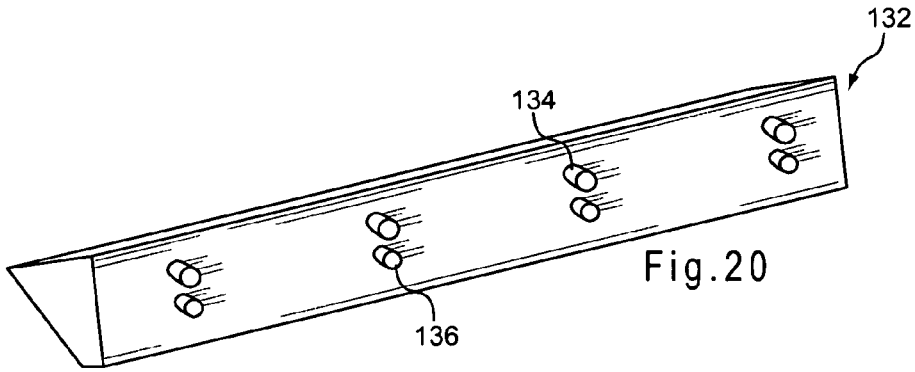
FIG. 20 shows a trapezoidal profile solid heat transfer element with two rows of widely spaced round vortex generators of two sizes from a perspective view.
Figure 21:
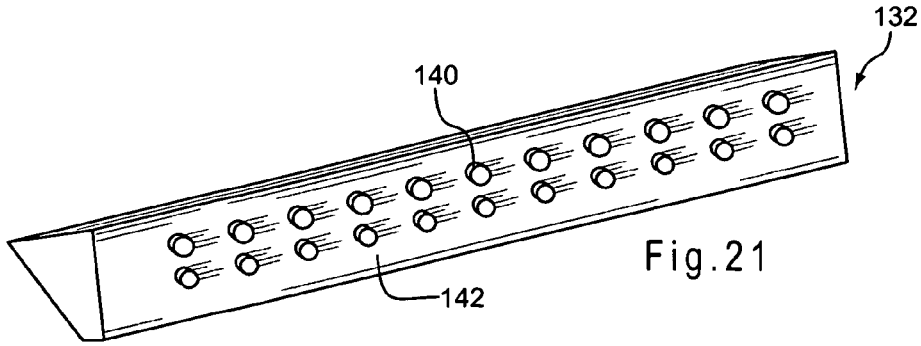
FIG. 21 shows a trapezoidal profile solid heat transfer element with two rows of round closely spaced vortex generators of two sizes from a perspective view.

FIGS. 19-25 have solid heat transfer elements with profile shapes that contribute larger wakes and potentially more heat transfer in comparison to a streamlined solid heat transfer element profile with the same vortex generators. They have sharp drop offs as the fluid passes over them creating larger wakes than a streamlined solid heat transfer profile element 100 would create. These wakes, larger than those created by the relatively small vortex generators, can create significant turbulent flow in the area directly behind the solid heat transfer element thereby creating undesirable pressure drop in comparison to the tear drop shaped profile solid heat transfer element 100. The Computational Fluid Dynamics software simulations show that the advantages of wake-inducing solid heat transfer element profile shapes over aerodynamic profile shapes are significant when no vortex generators are present. Once vortex generators are added to the designs, the heat transfer difference is insignificant but the wake-inducing profile shapes have significantly more pressure drop. Vortex generators on the surface of a streamline profile solid heat transfer elements is the preferred design choice. These drawings are included for comparison and to show other possible solid heat transfer element profiles that are symmetrical in relation to the fluid flow. Also, they illustrate additional vortex generator shapes, heights and angles of attack. In FIGS. 19-21 the fluid flow contacts the narrow end of the wedge shaped profiles first, then passes past the wide end. In FIGS. 22-25 are modified tear drop shapes where the fluid flow contacts the fat, rounded end first, then passes over a drop-off toward the narrow tail end.

Figure 22:
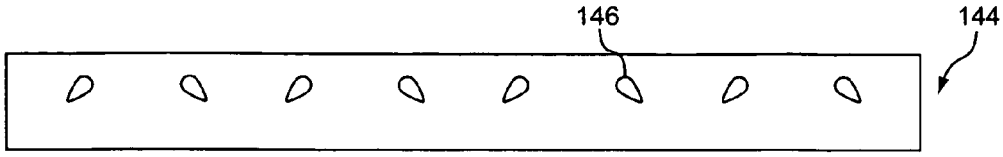
FIG. 22 shows a leaf like shaped profile solid heat transfer element with one row of tear drop shaped vortex generators placed at a 45 degree angle of attack from a top view.
Figure 23:
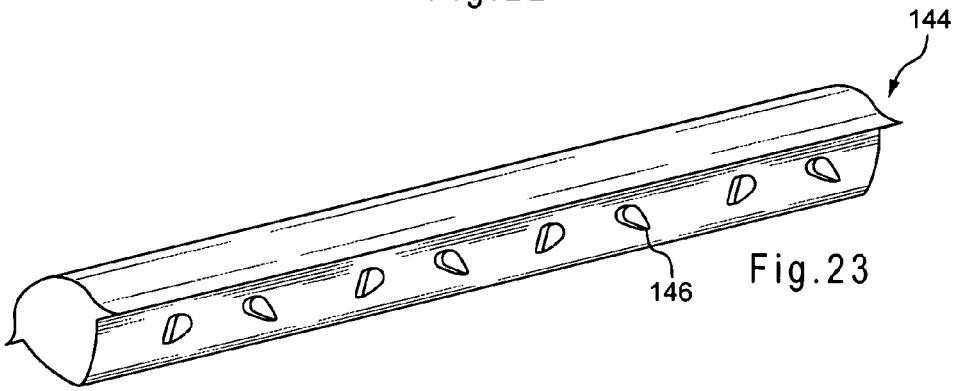
FIG. 23 shows a leaf like shaped profile solid heat transfer element with one row of tear drop shaped vortex generators placed at a 45 degree angle of attack from a perspective view.
Figure 24:
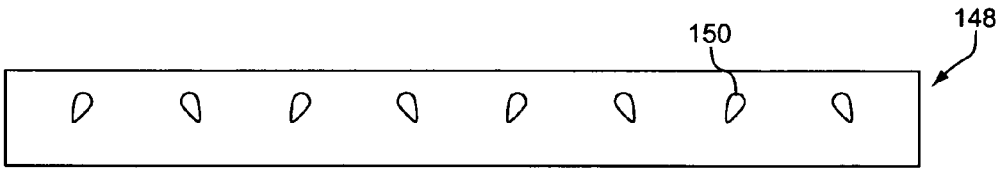
FIG. 24 shows a tadpole like shaped profile solid heat transfer element with one row of tear drop shaped vortex generators placed at a 30 degree angle of attack from a top view.
Figure 25:
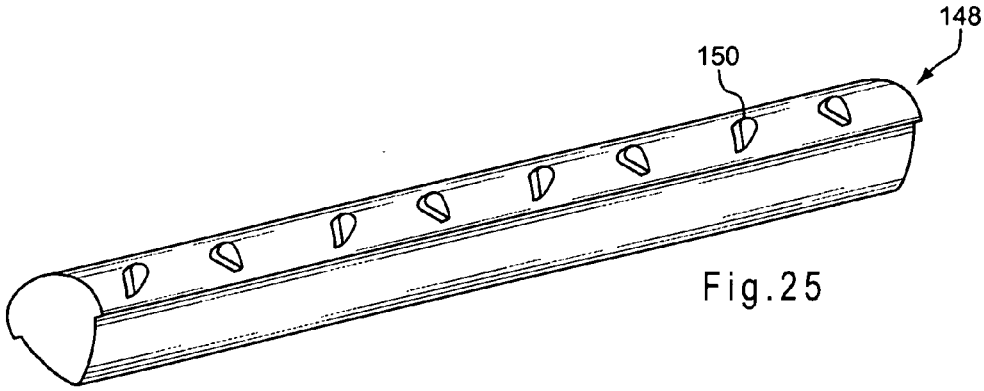
FIG. 25 shows a tadpole like shaped profile solid heat transfer element with one row of tear drop shaped vortex generators placed at a 30 degree angle of attack from a perspective view.

FIG. 19 shows a perspective view of solid heat transfer element 128 with a wedge shaped, 5 sided polygon profile and 2 rows of elliptical vortex generators 130 of moderate height. The rows of vortex generators are aligned parallel to one another. The angled fat end of the solid heat transfer element 128 the wedge fills some of the space where the turbulent flow collects. FIG. 20 shows a perspective view of solid heat transfer element 132 with a wedge shaped trapezoidal profile symmetrical in relation to the fluid flow with two rows of round vortex generators 134 and 136 with different circumferences. Here the vortex generators are of different sizes, and relatively high height and spaced relatively far apart. The extra height engages fluid flow further away from the solid heat transfer element. The rows of vortex generators are aligned parallel to one another. FIG. 21 shows a perspective view of solid heat transfer element with a wedge shaped trapezoidal profile symmetrical in relation to the fluid flow with two rows of round vortex generators 140 and 142. Here the vortex generators are of different circumferences, and relatively low height. FIG. 22 shows a solid heat transfer element 144 with a modified tear drop shaped profile, somewhat leaf shaped in form, from the top view. FIG. 23 is the perspective view. An edge of material flares out into the fluid flow to increase the wake across the whole length of the solid heat transfer element 144. It has a row of tear drop shaped vortex generators 146 at a 45 degree angle of attack in respect to the fluid flow and placed in the wake created by the raised edge of the material. FIG. 24 shows a solid heat transfer element 148 with a modified tear drop shaped profile, somewhat tadpole shaped in form, from the top view. FIG. 25 is the perspective view. It has a row of tear drop shaped vortex generators 150 at a 30 degree angle of attack in respect to the fluid flow and placed in front of the wake created by the edge dropping off. An edge drops off away from the fluid flow to increase the wake across the whole length of the solid heat transfer element 148.

Figure 26:
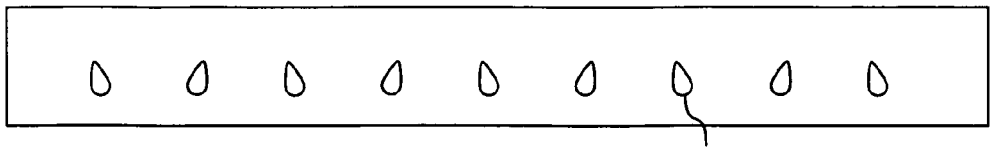
FIG. 26 shows a top view of a solid heat transfer element of undetermined profile with tear drop shaped vortex generators at a 15 degree angle of attack.
Figure 27:
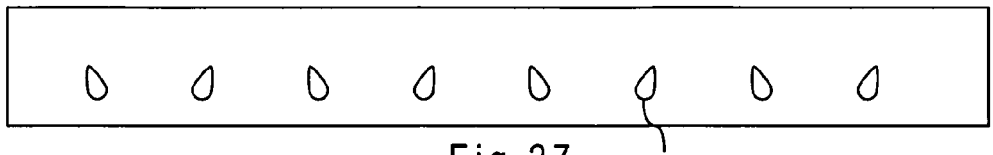
FIG. 27 shows a top view of a solid heat transfer element of undetermined profile with tear drop shaped vortex generators at a 30 degree angle of attack.
Figure 28:
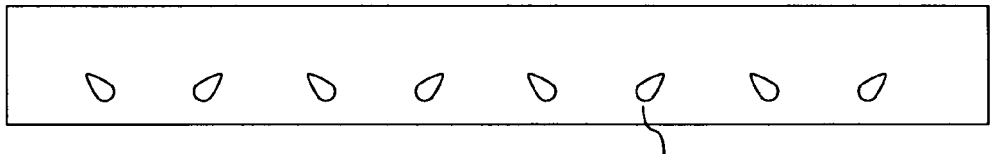
FIG. 28 shows a top view of a solid heat transfer element of undetermined profile with tear drop shaped vortex generators at a 45 degree angle of attack.
Figure 29:
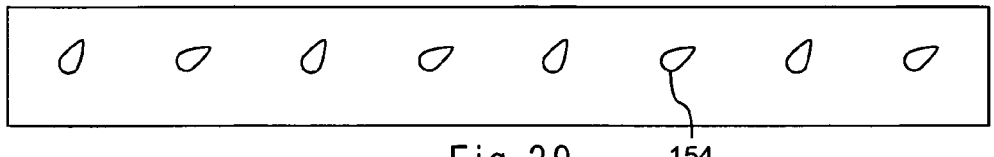
FIG. 29 shows a top view of a solid heat transfer element of undetermined profile with tear drop shaped vortex generators at a 15 degree angle of attack for elements that are installed transversely at a 45 degree angle in respect to the flow.

FIGS. 26-29 are top views of solid heat transfer elements of unspecified profile shape. They illustrate tear drop shaped vortex generators placed at various angles of attack. The angles of attack alternate in order to balance the stresses created by the wakes they create. FIG. 26 shows vortex generator 152 is at a 15 degree angle of attack in respect to the fluid flow. FIG. 27 shows vortex generator 150 at a 30 degree angle of attack. FIG. 28 shows vortex generator 146 at a 45 degree angle of attack. Vortex generators may be placed at any angle of attack between 0 and 45 degrees in respect to the fluid flow and angle above 45 degrees creates undesirable wake characteristics. FIG. 29 shows vortex generator 154 at a 15 degree angle of attack, and rotated 45 degrees for solid heat transfer elements installed at a 45 degree angle.

Figure 38:
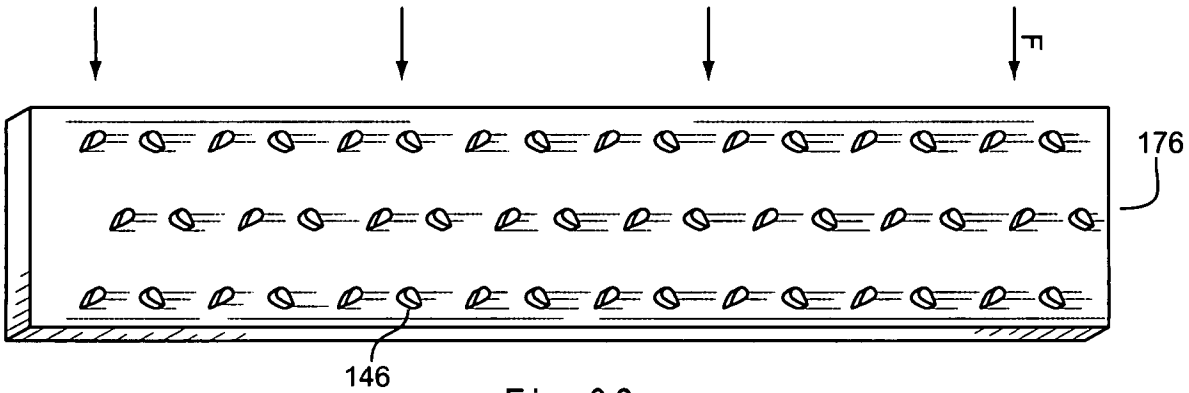
FIG. 38 shows a ribbon solid heat transfer element with three rows of tear drop shaped vortex generators placed at a 45 degree angle of attack.

FIGS. 38 and 39 are depictions of a solid heat transfer element 176 with a thin rectangular profile, typically called a ribbon element, with a direction of fluid flow indicated by arrows F. Ribbon element 176 is shown in FIG. 38 having 3 rows of tear dropped shaped vortex generators 146 at a 45 degree angle of attack in respect to the fluid flow with the rows staggered, and in FIG. 39 having 3 rows of triangular shaped vortex generators 178 at a 0 degree angle of attack in respect to the fluid flow with the rows staggered.

All of the vortex generators in the drawings, except vortex generators 102, 104 and 110, have straight sides and flat tops. This is for the clarity of illustration. Generally it is easier to manufacture vortex generators with sides angling toward the center of the vortex generator or curving toward the center of the vortex generator. Also, having angled or curved sides may help reduce wear. The vortex generators may be in other shapes, not shown. They can be chosen from list including, but not limited to, pyramids, flat topped pyramids, cones, flat topped cones, egg shaped, wedges, cylinders, hemispheres, tear drop shapes, triangles, ellipses, wedges, squares, rectangles, polygons or any shape that can be formed into a small size.

Figure 30:
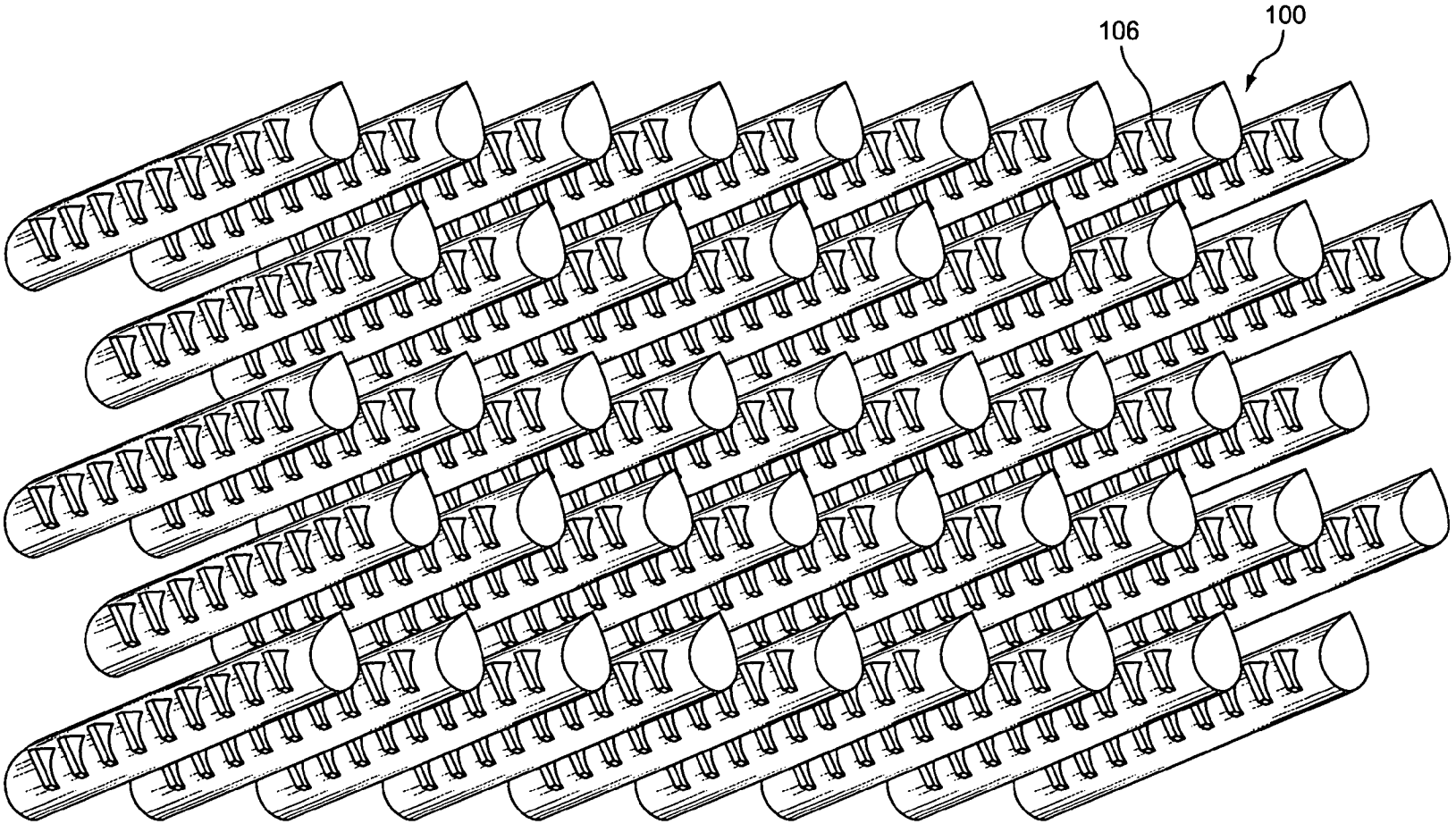
FIG. 30 shows an array of tear drop solid heat transfer elements with symmetrical vortex generators from a perspective angle.
Figure 31:
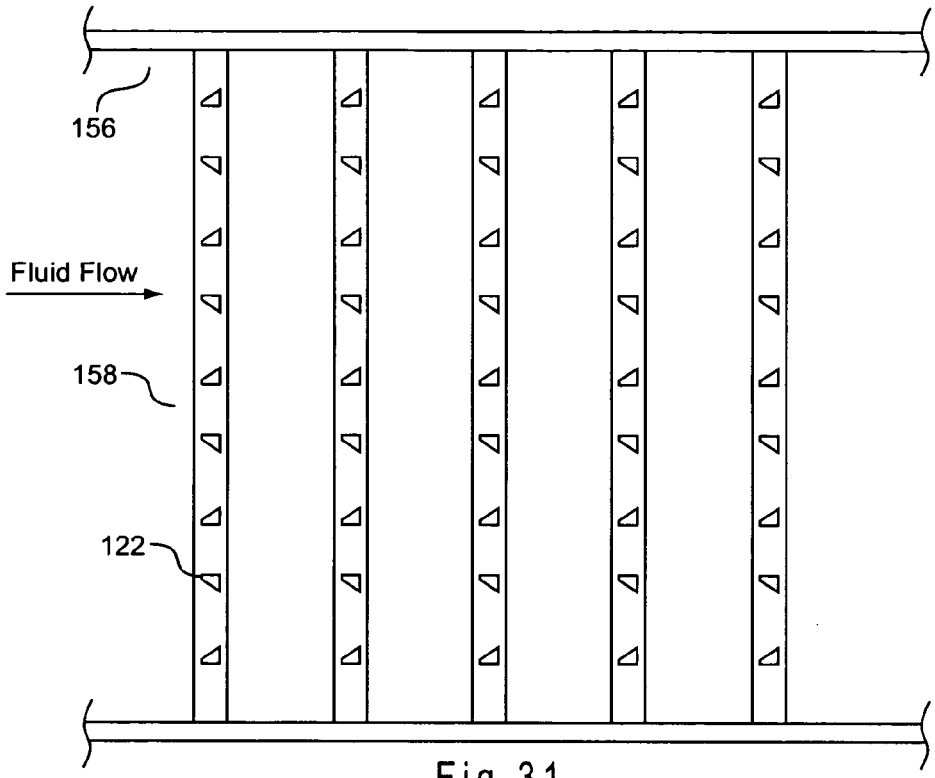
FIG. 31 shows array of solid heat transfer elements with asymmetrical vortex generators placed transversely to the fluid flow at a 90 degree angle from a side angle.
Figure 32:
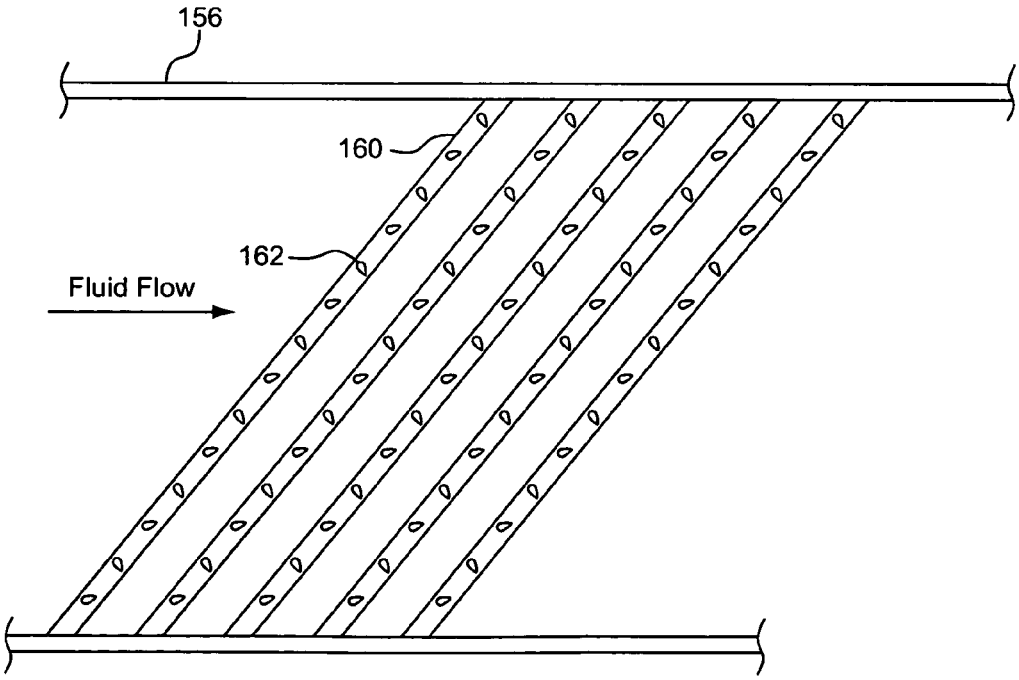
FIG. 32 shows an array of solid heat transfer elements with tear drop shaped vortex generators, at an angle of attack, placed transversely to the fluid flow at a 45 degree angle from a side angle.
Figure 34:
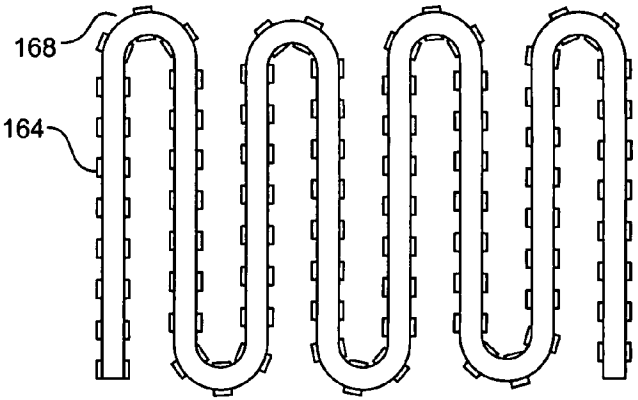
FIG. 34 shows a serpentine solid heat transfer element with vortex generators in an up and down pattern one row deep.

FIGS. 30-32 shows arrays of individual solid heat transfer elements. Each one is connected to a separate electric power source, not shown. These are separate wires connected to each element, or a circuit board. This allows for a greater wattage of heat to be provided to the whole system and allows for the individual elements to be supplied with different levels of wattage. This also allows for elements to be made from different materials, in one design one or a plurality of elements may be made of PTC ceramics as a safety measure. Once the specific PTC ceramics maximum temperature is reached, its electrical resistivity increases. The electric circuit can be designed so that electricity, and heat, will not be added to any of the solid heat transfer elements until the temperature of the PTC ceramic drops to the prescribed level.

FIG. 30 shows an array of elements, like FIG. 7 from a perspective view. They have solid heat transfer element with a tear drop shaped profile 100 and symmetrical vortex generators 106 at a 0 degree angle of attack. FIG. 31 shows an array of solid heat transfer elements 158 of non defined profile between fluid channel walls 156 oriented transversely to the fluid flow, perpendicularly. There are wedge shaped vortex generators 122 at a 0 degree angle of attack. In FIG. 32 the solid heat transfer elements 160 of non defined profile shapes are placed transversely to the fluid flow a 45 degree angle. The tear drop shaped vortex generators 162 are at a 30 degree angle of attack in relation to the fluid flow. The solid heat transfer elements may be oriented at any angle in relation to the fluid flow, but ideally the angle is between perpendicular and 45 degrees.

Figure 35:
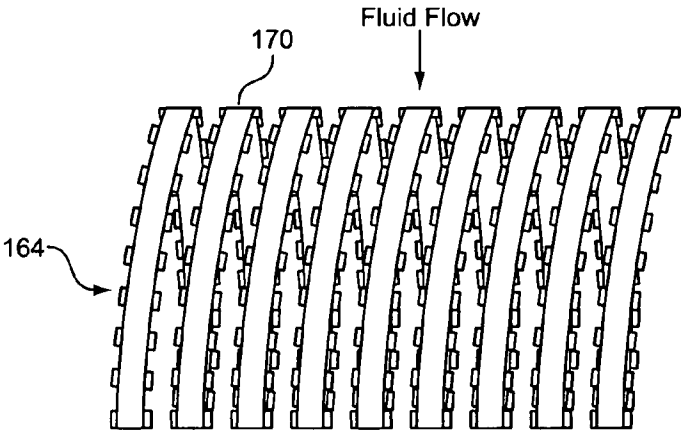
FIG. 35 shows a serpentine solid heat transfer element with vortex generators in a coil pattern.
Figure 33:
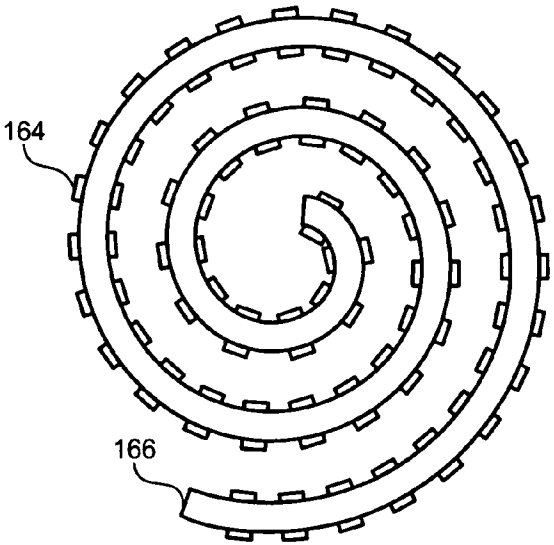
FIG. 33 shows a serpentine solid heat transfer element with vortex generators in an Archimedes spiral pattern that is one row deep.
Figure 36:
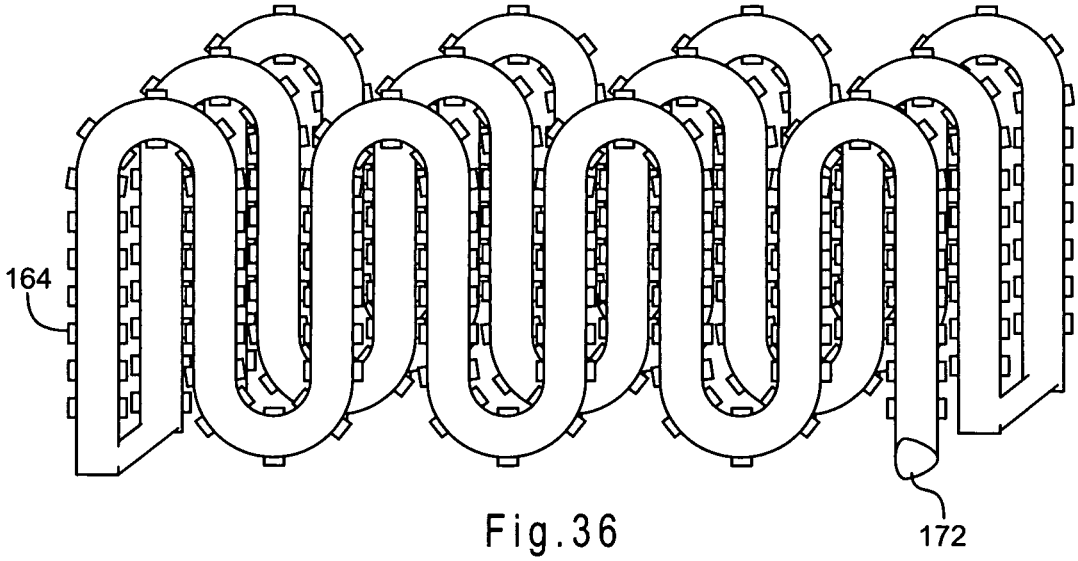
FIG. 36 shows a serpentine solid heat transfer element with vortex generators in an up and down pattern three rows deep.
Figure 37:
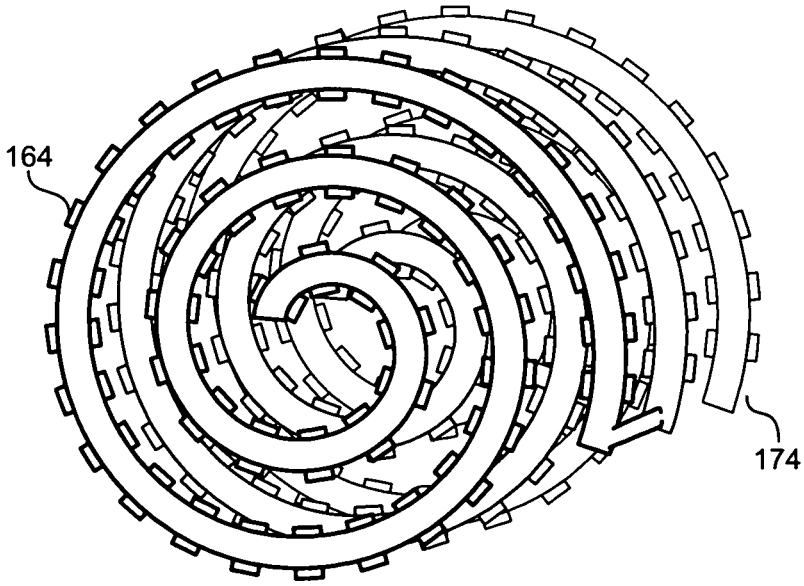
FIG. 37 shows a serpentine solid heat transfer element with vortex generators in an Archimedes spiral pattern that is three rows deep.

In FIGS. 33-37 the element array is created by a long, serpentine solid heat transfer element with one electric power connection. An alternative, not shown, would be to have a plurality of individually powered serpentine elements to create an array. The vortex generators 164 are of a non defined shape and angle of attack. The serpentine elements are generally more economical to build and are the likely the design choice for less expensive consumer applications. FIG. 33 shows a serpentine solid heat transfer element 166 in an Archimedes spiral and in FIG. 34 the serpentine element 168 is in an up and down pattern. You may install several individually powered serpentine elements like FIG. 33 and FIG. 34 behind each other to create an array where the elements are in line with each other or to create a staggered array. FIG. 35 shows a serpentine solid heat transfer element 170 in a coil pattern. The entire coil pattern of the solid heat transfer element 170 is placed transversely to the fluid flow, so the vortex generators 164 are at a constantly changing angle of attack in respect to the fluid flow. This means that the ideal choice for the vortex generator 164 shape in FIG. 35 is rotationally symmetrical, like the round cylinders in 130, 134, 136, 140 and 142; dome shaped or cone shaped. FIG. 36 is a serpentine solid heat transfer element 172 in a 3 row deep in line array made from one continuous wire and with one power source. This can be placed in an array of any plurality of rows, but 3 rows is easier to visualize in the drawings. The serpentine wire may also be made so the array is staggered, not shown. Solid heat transfer elements are rarely more than 6 to 8 rows deep because more will create unacceptably high pressure drop. FIG. 37 shows a solid heat transfer element 174 in an Archimedes spiral 3 rows deep creating an in line array. Again, the serpentine wire may be formed to create a staggered array, not shown. An array may be created from one serpentine wire with vortex generators into numerous patterns. The drawings show several simple patterns, but the design is not limited to the patterns shown and described.

One application, not shown, is inspired by the ceramic electrically resistive plates common in space or room heaters. A plate with a fluid flow passing over it does not provide ideal heat transfer. The solid heat transfer elements, instead of being relatively thin electrically resistant wire like those used in a hair dryer, may be relatively thick and formed from ceramics or from ceramics with a wire running down the center. The solid heat transfer elements's profile shapes, the arrays of the heat transfer elements and vortex generator types and placements may be chosen from those shown in the drawings or in the above description. The benefits of utilizing streamlined solid heat transfer element profile shapes and wake inducing vortex generators are present regardless of the scale of the solid heat transfer element.

The use of vortex generators and streamlined solid heat transfer element profiles can improve the performance of resistance heating elements in a myriad of products. The present invention is directed to solid heat transfer elements as a component part, and is not limited to their incorporation in any particular assembled product. Specifically, the present invention is directed to the shape of solid heat transfer elements, including the aerodynamic profile shape to control pressure drop and the addition of vortex generators to improve heat transfer by increasing surface area and improving the mixing of fluid layers. Solid heat transfer elements which generate heat via internal resistance to an electric current passing through them can be a component part chosen from a list but not limited to space air heaters, industrial air heaters, flash water heaters, oil heaters, hair dryers, hand dryers, heat guns, building electric furnaces, industrial electric furnaces, ovens, clothes dryers, water boilers, steamers, car wash dryers, the drying cycle of dishwashers, paper mill dryers, food dehydrators or any of the myriad of home and industrial applications of heating air, water, oil or other fluids.

Description of an Alternative Embodiment

In the alternative embodiment, the main difference is the source of electrically provided heat. The detailed description of FIGS. 1-39 and the related part numbers is identical to the description in the preferred embodiment, and are not repeated here. In the alternative embodiment there is no electricity source connected directly to the solid heat transfer elements. Instead, electricity powers infrared emitting lamps, or another means, which emit infrared radiation. The infrared radiation is continuously absorbed by the solid heat transfer elements, whose surface is ideally coated to maximize infrared absorption, causing the solid heat transfer elements to heat up. Once the solid heat transfer elements are heated, they transfer heat to the fluid flow in exactly the same manner as the preferred embodiment. The solid heat transfer elements give up heat to the fluid flow, and absorb heat from the infrared waves given off by the heat lamps or other infrared emitting source. The infrared radiation absorbing solid heat transfer elements are ideally made of a metal with high heat conductivity and low specific heat. In order for a surface to absorb infrared radiation it needs to have high absorptivity, low reflectivity and low transmissivity. This is achieved normally by using a black or other colored coating with high absorptivity.

The solid heat transfer elements may be arranged from many solid heat transfer elements or from long serpentine elements as in FIGS. 30-37 and as described in the preferred embodiment. FIGS. 40 and 41 show an array of elements along with hoods which contain infrared emitting heat lamps or other infrared absorbing means. The solid heat transfer element profile shapes and vortex generator types and placements can be chosen from a list not including but not limited to the drawings in FIGS. 1-29 and as described in the preferred embodiment.

FIG. 40 shows ribbon type infrared absorbing solid heat transfer elements 181 in an array between two hoods 180 which contain infrared emitting heating lamps, not shown. The solid transfer heating elements are placed so that there is no space between them relative to a line parallel to the heat lamps so that the maximum amount of infrared radiation from the infrared lamps contacts the solid heat transfer elements. Also, every solid heat transfer element 181 is directly exposed to the infrared heat radiation. FIG. 41 shows ribbon type infrared absorbing solid heat transfer elements 181 in an array next to one hood 180 which contain infrared heating lamps, not shown. Arrays of infrared absorbing solid heat transfer elements could be installed in a means similar to FIGS. 30-37, but the placement must be modified so there are no gaps between the solid heat transfer elements. Gaps would allow infrared radiation to pass by unabsorbed. Also, they are ideally arranged so no solid transfer heating element is blocked from receiving infrared radiation by the placement of another solid heat transfer element.

Currently infrared heat is typically used to heat solids or liquids directly, only occasionally is it used to heat air. Usually an infrared absorbing plate is exposed to infrared radiation and transfers the heat to the air. The solid heat transfer elements described in the present invention provide a more efficient means to heat air and can also be used to heat liquids. The present invention allows infrared absorbing solid heat transfer elements to be utilized in many of the same applications which typically utilize resistance heating elements because infrared absorbing heating elements and electrically resistive heating elements can be formed into similar shapes.

Description of an Alternative Embodiment

Another alternative embodiment is like the infrared absorbing solid heat transfer element embodiment, except in that the solid heat transfer element absorbs radio waves, the radio wave spectra defined as including microwaves. Microwaves are high frequency radio waves classified as extremely high frequency waves, super high frequency waves and ultra high frequency waves. Radio wave absorbing elements according to the present invention may be configured to give off heat to a fluid flow in substantially the same manner as the electrical elements described above with reference to FIGS. 1-39, with the key difference being the manner in which heat is generated in the radio wave absorbing elements. Turning to FIGS. 40 and 41, hoods 180 containing radio wave emitting magnetrons or other radiofrequency emitting source adapted to emit radiation R, which may be radiofrequency waves or microwaves, are illustrated schematically. Solid heat transfer elements 181 absorb heat from radiation R emanating from hoods 180 and give up heat to the fluid flow.

In this alternative embodiment, solid heat transfer element 181 is a susceptor. A susceptor is a material used for its ability to absorb electromagnetic energy. In this embodiment the electromagnetic energy is radiofrequency including microwave radiation. The susceptor may be made from any suitable radio wave absorbing material, including but not limited to carbide, molybdenum, tungsten, silicon carbide, stainless steel or aluminum. Susceptors are currently used in high temperature industrial applications and microwave cooking. By utilizing susceptors in the shapes of solid heat transfer elements described above they can be used to heat fluids to high temperatures, even those with low densities. Fluids that have low polarity, or are nonpolar, are poor candidates to be heated directly by radio waves. The radio waves can be used to heat the solid heat transfer elements made of a susceptor material, and the solid heat transfer element then heats the fluid.

Once the solid heat transfer elements are heated, they transfer heat to the fluid flow in exactly the same manner as the preferred embodiment. The solid heat transfer elements continuously give up heat to the fluid flow, and continuously absorb heat from the infrared photons given off by the heat lamps or other infrared emitting source.

Description of a Preferred Manufacturing Technique

There are several ways to create solid heat transfer elements with a wide variety of profiles and with raised vortex generators. If the material is malleable, that is, capable of being plastically deformed, forming the profile shape and vortex generators via passing them through two gear-like wheels is preferred. This is the simplest and most economical means of creating solid heat transfer elements in significant quantity. Because the elements are solid bodied it is a straightforward process to plastically deform them by applying pressure.

In wire and nail factories, for example, round wire with a width greater than the desired final width is passed through a series of gear-like wheels. It may be heated if necessary. As it passes past a plurality of wheels the wire is stretched and the diameter narrows gradually to the desired width. It is rarely done with only one wheel as this may stress the wire, causing it to break.

Figure 46:
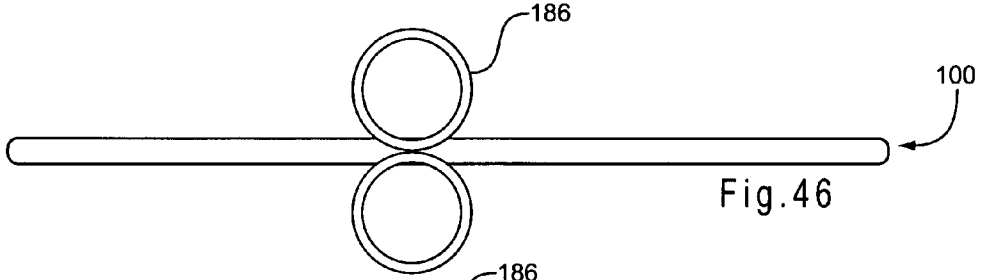
FIG. 46 shows the solid heat transfer element passing through the gear-like wheels to create the vortex generators from the top view.
Figure 47:
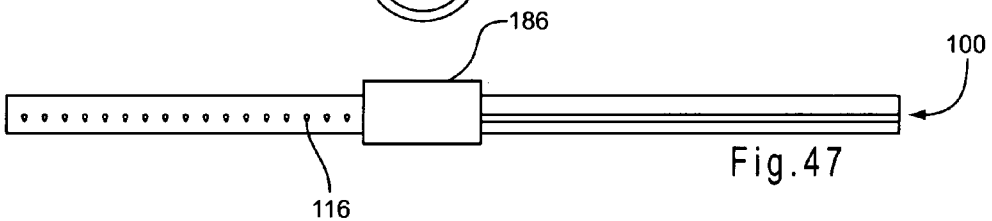
FIG. 47 shows the solid heat transfer element passing through the gear-like wheels to create the vortex generators from the side view.
Figure 48:
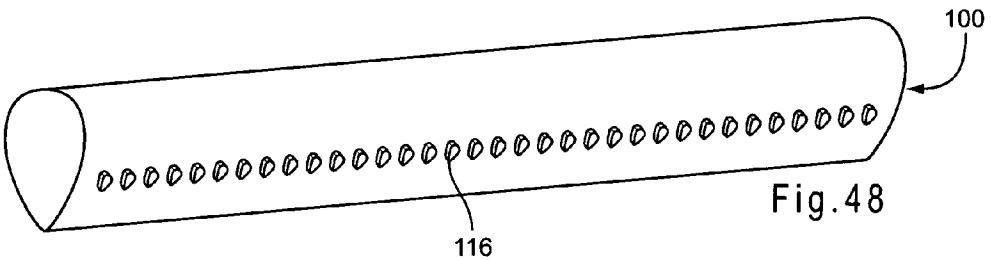
FIG. 48 shows a tear drop profile solid heat transfer element after the vortex generators have been created.
Figure 44:
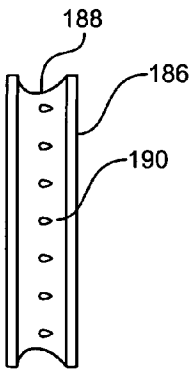
FIG. 44 shows the top gear-like wheel that plastically deforms the solid heat transfer element to create the vortex generators and can also be used to shape the solid heat transfer element into a tear drop shaped profile.
Figure 45:
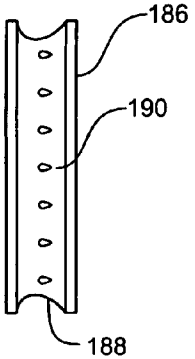
FIG. 45 shows the bottom gear-like wheel that plastically deforms the solid heat transfer element to create the vortex generators and can also be used to shape the solid heat transfer element into a tear drop shaped profile.

FIGS. 44 and 45 are top and bottom gear-like wheels 186 for plastically deforming the wire. They have a half tear drop shaped groove 188 for forming the top or lower half of the solid heat transfer elements profile. They also have tear drop shaped dimples 190 for raising the vortex generators. The ideal embodiment has the round wire transforming toward the tear drop shape profile with vortex generators in a series of steps by passing though a plurality of gear-like wheels, only the last set FIGS. 44 and 45 are shown. Each successive pair of wheels is less round, and more tear drop shaped. The last wheel or group of wheels also has dimples 190 which are successively deeper so that the vortex generators 116 are raised to the desired height gradually. Or the vortex generators 116 are formed by passing through one set of wheels 186. FIG. 46 shows the top view of the solid heat transfer element 100 passing between 2 gear-like wheels 186. FIG. 47 shows a side view of solid heat transfer element 100 being passed through the gear-like wheels 186. FIG. 48 shows the finished solid heat transfer element.

A similar means is used to create the thin rectangle profile shaped solid heat transfer elements, usually called ribbon elements. This method is not shown. A ribbon of malleable material is purchased or cut, then passed through a pair, or a plurality of pairs, of gear-like wheels. Here the wheels have a groove which is half of a narrow rectangle and has dimples shaped like vortex generators. The vortex generators may be raised in one step or a series of steps.

The long solid heat transfer element 100 may be cut into short sections for multiple element installations, or left as a long element for installation as a serpentine element.

Description of an Alternative Manufacturing Technique

Figure 43:
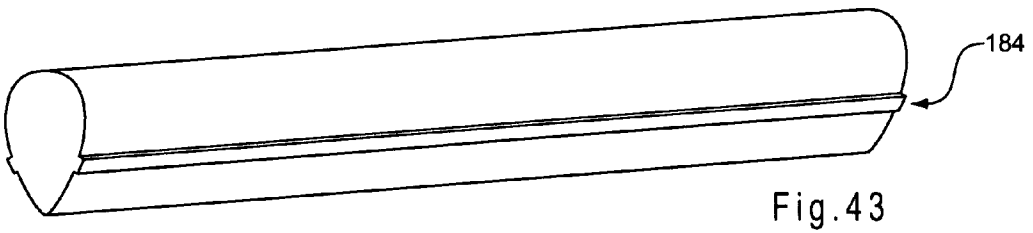
FIG. 43 shows a tear drop profile solid heat transfer element with a strip of raised material; this strip will later be plastically deformed to form the vortex generators.
Figure 42:
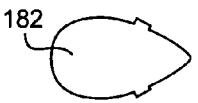
FIG. 42 shows an extrusion dye profile.

The first alternate manufacturing technique embodiment is similar to the preferred embodiment. In FIG. 43 a wire shaped close to the final shape 184 is extruded so it has a raised edge of material. FIG. 42 shows the extrusion dye with a profile 182 matching the profile of the extruded wire 184. This method requires less plastic deformation of the wire than if you started with a standard round wire with no raised edge of material. The preformed solid heat transfer element 184 passes through one or a plurality of gear-like wheels 186 that form the vortex generators 116 on one step, or several steps. The gear-like wheels 186 transform the strip of raised material into vortex generators 116. This method allows for fewer gear-like wheels for plastically deforming the solid heat transfer elements.

Description of an Alternative Manufacturing Technique Embodiment

Figure 49:
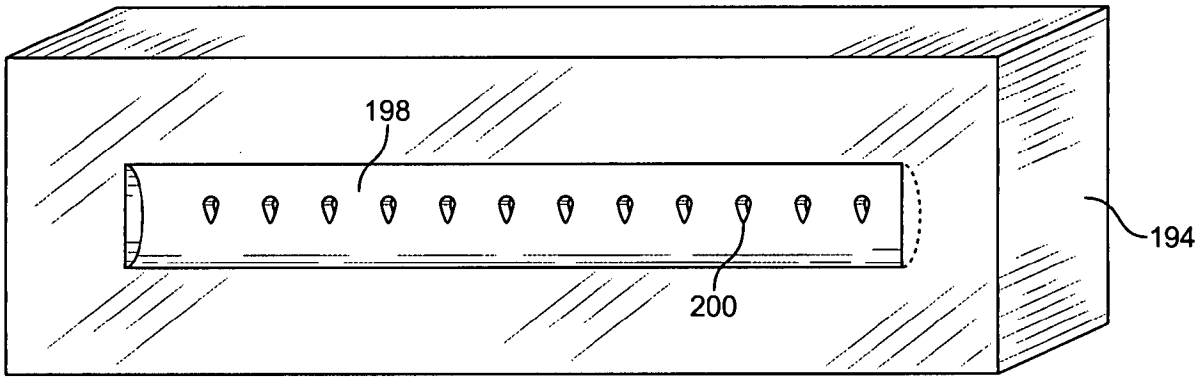
FIG. 49 shows the top half of a mold for producing solid heat transfer elements via pouring, sintering or stamping.
Figure 50:
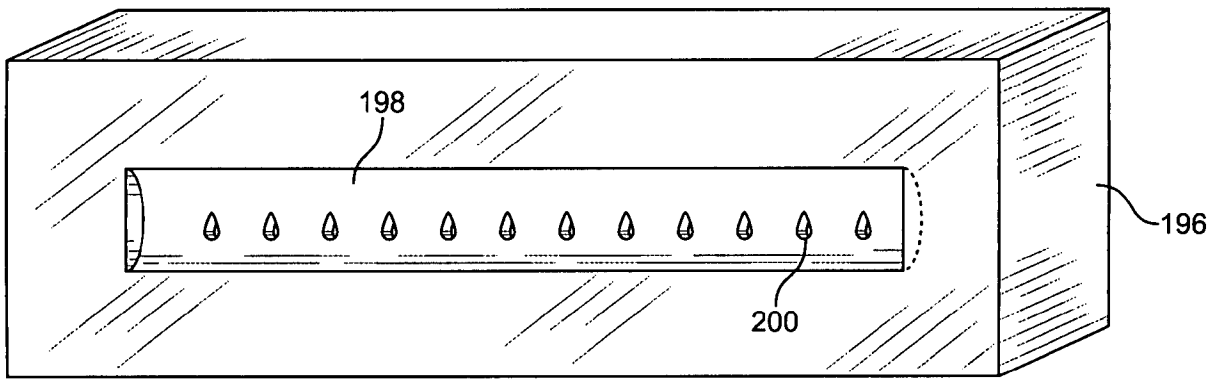
FIG. 50 shows the bottom half of a mold for producing solid heat transfer elements via pouring, sintering or stamping.

When the choice of material does not take to extrusion or plastic deformation well, the better method is to use molds. This is especially true if made of ceramic materials, or when wire is encased by ceramics. Electrically resistive material is often brittle. FIG. 49 shows the top side of a mold 194 and FIG. 50 shows the bottom side of a mold 196. They are mirror images of each other. They are indented with half of the desired profile shape 198 and have dimples 200 that are in the shape of vortex generators.

These molds can be used be used to create the solid heat transfer element via sintering, a common method used for making complex ceramic shapes. Powdered ceramics and/or metals are placed in the mold and pressed between the molds 194 and 196. Heat may be added, or the pressure may provide the needed heat. The pressure and heat cause the powder to form into a sold conforming to the shape of the mold. It is less practical to utilize this method to create a long serpentine solid heat transfer element. A wire may be placed in the center of the powdered material before the solid heat transfer element is formed around the wire.

The molds 194 and 196 can be used to form solid heat transfer elements by stamping. A blank of material which is receptive to plastic deformation is placed between the molds 194 and 196 and pressure is applied, thereby plastically deforming the material into the shape of a solid heat transfer element.

The molds 194 and 196 can also be used to form a solid heat transfer element by pouring material heated to the liquid state into the molds and then cooled.

The elements may also be created by machining. A blank of material larger than the final solid heat transfer element is chosen, and is machined down until the desired profile shape and vortex generators are left. This method is likely to be used only for large, custom manufactured solid heat transfer elements. It is also likely to be used if the chosen material is carbide.

Conclusion, Ramifications And Scope Of Invention

Accordingly, the reader will see that the solid heat transfer element of the present invention is a significant improvement over the smooth round, rectangular or oval solid heat transfer elements common in the marketplace today. It has many advantages in that:

It provides a streamlined profile shape which reduces drag and the associated pressure drop so that less force is needed to move the fluid flow past the solid heat transfer elements.

It provides vortex generators which create micro wakes which improve heat transfer characteristics without significant increase in drag and pressure drop.

It provides vortex generators that increase surface area of the solid heat transfer element thereby increasing the surface area available to transfer heat to the fluid flow.

It permits simple production methods for mass production of solid heat transfer elements, via plastic deformation or use of molds.

It permits many choices for designing solid heat transfer elements to suit a specific application such as; shape of the solid heat transfer element profiles, vortex generator shape and placement, use of a serpentine solid heat transfer element or a plurality of shorter ones, the angle of placement of the solid heat transfer elements in relation to the fluid flow and the spacing of the elements in relation to each other, the wide variety of materials it may be made from and the choice whether to utilize electrical resistance or infrared absorption as the source of the heat.

It provides more efficient heat transfer so electricity is saved.

It provides efficient heat transfer allowing the solid heat transfer elements to operate at a cooler temperature potentially improving safety and reducing stress and wear on the elements. In addition by transferring the heat to the fluid quicker, this could leave less residual heat in the element. Residual heat can emit from the element via re-radiation and this infrared radiation could pass through the fluid and heat surrounding components, causing damage.

Although the description above contains many specificities, these should not be construed as limiting the scope of the invention but merely providing illustrations of some of the presently preferred embodiments of this invention. The solid heating element profile shapes and vortex generator shapes and angles of attack can be combined into a myriad of choices. Also the solid heat transfer elements may be placed in any number of arrays to match the fluid channel shapes, fluid flow patterns, fluid speeds and desired temperatures to meet the challenges that myriad products may place on this component part.

Thus the scope of the invention should be determined by the appended claims and their legal equivalents, rather than by the examples given.

What is claimed is:

1. A solid heat transfer element for generating heat from an electric current passing through its electrically resistant material and transferring the heat to an air flow in communication with the solid heat transfer element, comprising:

an elongate member composed of an electrically resistive, heat generating material, placed transversely to the air flow with an aerodynamic profile, symmetrical in respect to the air flow, the elongate member having a cylindrical surface including a surface area in contact with the air flow; and male protrusions extending from the cylindrical surface of the elongate member into the fluid flow, the male protrusions configured to provide additional surface area in contact with the air flow and to generate vortices to mix heated air layers to increase the rate of heat transfer from the elongate member to the air flow, and the male protrusions being of a shape selected from the group consisting of an a tear drop shape and an egg shape, the male protrusion shape generally tapering to a narrower dimension in the direction of air flow.

2. The solid heat transfer element of claim 1, wherein said electrically resistive material is selected from the group consisting of FeCrAl, NiFe, NiCrFe, CuNi, CaCu, MoSi, Silicon Carbide, PTC ceramics and resistance wire encased in ceramics.

3. The solid heat transfer element of claim 1 wherein said solid elongate member is oriented transversely at an angle between 45 and 90 degrees with respect to the air flow.

4. An array of solid heat transfer elements according to claim 1 comprising an array of the solid elongate members.

5. The array of claim 4, wherein the array comprises a plurality of offset rows of the elongate members, each row comprising a plurality of the elongate members spaced apart in a direction transverse to the air flow and parallel to one another.

6. The array of claim 5, wherein each elongate member in a row is spaced in the direction of air flow from a corresponding elongate member in an adjacent row.

7. The array of claim 5, wherein the rows are staggered in relation to one another so that no elongate member in a row is spaced in the direction of air flow from a corresponding elongate member in an adjacent row.

8. The solid heat transfer element of claim 1, wherein the elongate member is formed in a serpentine bent pattern, the bent pattern including an array of straight portions of the elongate member, the array comprising a plurality of rows of the straight portions, each row comprising a plurality of the straight portions spaced apart in a direction transverse to the air flow and parallel to one another.

9. The solid heat transfer element of claim 8, wherein each straight portion in a row is spaced in the direction of air flow from a corresponding straight portion in an adjacent row.

10. The solid heat transfer element of claim 8, wherein the rows are staggered in relation to one another so that no straight portion in a row is spaced in the direction of air flow from a corresponding straight portion in an adjacent row.

11. The solid heat transfer element of claim 1 wherein said elongate member is helical.

12. The solid heat transfer element of claim 1 wherein at least a part of said solid elongate member is spiral shaped.

13. The solid heat transfer element of claim 1 wherein said elongate member has a symmetrical profile shape selected from the group consisting of aerofoils, tear drops, egg shapes, wedges, ellipses, circles, and ovals.

14. The solid heat transfer element of claim 1 wherein said vortex generating male protrusions are oriented at an angle of attack between about 0 and about 45 degrees with respect to the air flow.

15. A solid heat transfer element for absorbing energy from a source of electromagnetic radiation and transferring the energy as heat to a air flow in communication with the solid heat transfer element, comprising:

an elongate member adapted to absorb electromagnetic radiation, the elongate member oriented transversely to the air flow and exposed to the source of electromagnetic radiation, the elongate member having a profile that is symmetrical with respect to the air flow, the elongate member having a cylindrical surface including a surface area in contact with the air flow; and male protrusions extending from the cylindrical surface of the elongate member into the air flow, the male protrusions configured to provide additional surface area in contact with the air flow and to generate vortices to mix heated air layers to increase the rate of heat transfer from the elongate member to the air flow, and the male protrusions being of a shape selected from the group consisting of a tear drop shape and an egg shape, the male protrusion shape generally tapering to a narrower dimension in the direction of air flow.

16. The solid heat transfer element of claim 15, wherein said elongate member is adapted to absorb infrared radiation.

17. The solid heat transfer element of claim 16, wherein said elongate member includes a coating composed of a material adapted to absorb infrared radiation and a core composed of a material adapted to absorb heat energy conductively from the coating.

18. The solid heat transfer element of claim 15, wherein said elongate member is adapted to absorb radio waves, including microwaves.

19. The solid heat transfer element of claim 18, wherein said elongate member comprises a radio wave absorbing material selected from the group consisting of carbide, molybdenum, tungsten, silicon carbide, stainless steel and aluminum.

20. The solid heat transfer element of claim 15 wherein said elongate member is placed transversely at an angle between about 45 and about 90 degrees with respect to the air flow.

21. An array of solid heat transfer elements according to claim 15 comprising an array of the solid elongate members.

22. The array of claim 21, wherein the array comprises a plurality of offset rows of the elongate members, each row comprising a plurality of the elongate members spaced apart in a direction transverse to the air flow and parallel to one another.

23. The array of claim 22, wherein each elongate member in a row is spaced in the direction of air flow from a corresponding elongate member in an adjacent row.

24. The array of claim 22, wherein the rows are staggered in relation to one another so that no elongate member in a row is spaced in the direction of air flow from a corresponding elongate member in an adjacent row.

25. The solid heat transfer element of claim 15, wherein the elongate member is formed in a serpentine bent pattern, the bent pattern including an array of straight portions of the elongate member, the array comprising a plurality of rows of the straight portions, each row comprising a plurality of the straight portions spaced apart in a direction transverse to the air flow and parallel to one another.

26. The solid heat transfer element of claim 25, wherein each straight portion in a row is spaced in the direction of air flow from a corresponding straight portion in an adjacent row.

27. The solid heat transfer element of claim 25, wherein the rows are staggered in relation to one another so that no straight portion in a row is spaced in the direction of air flow from a corresponding straight portion in an adjacent row.

28. The solid heat transfer element of claim 15 wherein said elongate member is helical.

29. The solid heat transfer element of claim 15 wherein at least a part of said elongate member is spiral shaped.

30. The solid heat transfer element of claim 15 wherein said elongate member has a symmetrical profile shape selected from the group consisting of aerofoils, tear drops, egg shapes, wedges, ellipses, circles, and ovals.

31. The solid heat transfer element of claim 15 wherein said vortex generating male protrusions are oriented at an angle of attack of from about 0 to about 45 degrees with respect to the air flow.

32. The solid heat transfer element of claim 14 wherein said vortex generating male protrusions are oriented at an angle of attack of about 15 degrees with respect to the air flow.

33. The solid heat transfer element of claim 31 wherein said vortex generating male protrusions are oriented at an angle of attack of about 15 degrees with respect to the air flow.

34. The solid heat transfer element of claim 13, wherein said elongate member has a symmetrical profile shape selected from the group consisting of aerofoils and tear drops.

35. The solid heat transfer element of claim 30, wherein said elongate member has a symmetrical profile shape selected from the group consisting of aerofoils and tear drops.

* * * * *